US009146498B2

(12) United States Patent
Komatsu et al.

(10) Patent No.: US 9,146,498 B2
(45) Date of Patent: Sep. 29, 2015

(54) IMAGE FORMING APPARATUS

(71) Applicants: Makoto Komatsu, Kanagawa (JP); Shinji Kato, Kanagawa (JP)

(72) Inventors: Makoto Komatsu, Kanagawa (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 13/972,283

(22) Filed: Aug. 21, 2013

(65) Prior Publication Data

US 2014/0064759 A1 Mar. 6, 2014

(30) Foreign Application Priority Data

Aug. 31, 2012 (JP) ..... 2012-191021

(51) Int. Cl.

*G03G 15/08* (2006.01)
*G03G 13/06* (2006.01)
*G03G 15/01* (2006.01)

(52) U.S. Cl.

CPC ..... *G03G 15/0849* (2013.01); *G03G 13/06* (2013.01); *G03G 15/0855* (2013.01); *G03G 15/0879* (2013.01); *G03G 15/0189* (2013.01); *G03G 2215/0607* (2013.01)

(58) Field of Classification Search

CPC ..... G03G 15/0824; G03G 15/0848; G03G 15/0849–15/0855

USPC ..... 399/53, 55, 56, 46, 49

See application file for complete search history.

(56) References Cited

U.S. PATENT DOCUMENTS

| | | | | |
|---|---|---|---|---|
| 5,839,018 | A * | 11/1998 | Asanuma et al. | 399/43 |
| 7,394,999 | B2 * | 7/2008 | Zaima | 399/27 |
| 7,577,371 | B2 * | 8/2009 | Zaima | 399/27 |
| 7,668,471 | B2 * | 2/2010 | Takeuchi et al. | 399/30 |
| 7,684,715 | B2 * | 3/2010 | Zaima | 399/27 |
| 2004/0164691 | A1 | 8/2004 | Andoh et al. | |
| 2004/0197110 | A1 * | 10/2004 | Bessho et al. | 399/27 |
| 2006/0056864 | A1 * | 3/2006 | Zaima | 399/27 |
| 2006/0152775 | A1 * | 7/2006 | Itoyama et al. | 358/504 |
| 2007/0053703 | A1 * | 3/2007 | Hirayama | 399/27 |
| 2007/0269228 | A1 * | 11/2007 | Takeuchi et al. | 399/30 |

(Continued)

FOREIGN PATENT DOCUMENTS

JP 9-6120 1/1997

OTHER PUBLICATIONS

U.S. Appl. No. 13/753,859, filed Jan. 30, 2013.

*Primary Examiner* — David Gray
*Assistant Examiner* — Carla Therrien
(74) *Attorney, Agent, or Firm* — Oblon, McClelland, Maier & Neustadt, L.L.P.

(57) ABSTRACT

An image forming apparatus includes a controller and an imaging unit having a developing device to develop a latent image on a surface of a latent image carrier with toner. When control target value of control parameters that influence a developing ability of the imaging unit becomes inappropriate, the controller performs target value correction processing of correcting the control target value to bring the control target value close to an appropriate value for stabilizing a development density of the imaging unit. In the target value correction processing, the controller corrects a control target value of a second control parameter having a response speed, obtained when the developing ability is changed by the correction, faster than a first control parameter, correct the control target value of the first control parameter, and then turn the control target value of the second control parameter back to the original value.

9 Claims, 18 Drawing Sheets

(56) References Cited

U.S. PATENT DOCUMENTS

| | | | | |
|---|---|---|---|---|
| 2008/0025742 | A1 | 1/2008 | Kato et al. | |
| 2008/0124107 | A1* | 5/2008 | Takeuchi et al. | 399/59 |
| 2009/0110422 | A1* | 4/2009 | Shinichi | 399/55 |
| 2011/0318024 | A1* | 12/2011 | Kawaguchi | 399/27 |
| 2012/0051760 | A1 | 3/2012 | Komatsu | |
| 2012/0201552 | A1 | 8/2012 | Hirai et al. | |
| 2013/0108288 | A1 | 5/2013 | Kaneko et al. | |
| 2013/0108292 | A1 | 5/2013 | Suzuki et al. | |
| 2013/0230332 | A1* | 9/2013 | Ishii | 399/27 |
| 2013/0243456 | A1* | 9/2013 | Kaneko et al. | 399/48 |

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2012-191021, filed on Aug. 31, 2012 in the Japan Patent Office, the entire disclosure of which is hereby incorporated by reference herein.

BACKGROUND

1. Field

The present invention relates to an image forming apparatus to perform target value correction processing to stabilize a development density by correcting a control target value of a control parameter, which influences a developing ability of an imaging unit.

2. Discussion of the Related Art

The image forming apparatus described in JP-H09-006120-A has been known as this type of image forming apparatus. In the case where a predetermined retention time or more has passed, the image forming apparatus corrects a control target value of toner concentration of a two-component developer used for development as a control parameter, which influences a developing ability of an imaging device including a photoreceptor and a developing device. Specifically, the retention time is a time period during which an image forming operation is continuously stopped. During the retention time, the two-component developer in the developing device is left to stand without being stirred. As the retention time becomes longer, toner charge amount (Q/M) of the two-component developer decreases. As a result, the output from a toner concentration sensor shifts from the actual toner concentration to a lower concentration, which leads to misdetection of low toner concentration. Then, in the case of the image forming operation performed after the predetermined retention time or more, the image forming apparatus described in JP-H09-006120-A performs target value correction processing for correcting the control target value of the toner concentration to a value lower than a normal value. As a result, the toner concentration can be kept at an appropriate value even after the predetermined retention time or more.

As a result of intensive studies, the inventors have found that, after a predetermined retention time or more, it is desirable to correct a control target value of toner concentration not only because the output from the toner concentration sensor shifts to a lower concentration than usual but also for the reasons below. That is, when the retention time becomes quite long, the toner charge amount (Q/M) of the two-component developer decreases to a significant level. Then, electrical adhesion of toner particles attracting to the carrier in the two-component developer is considerably weakened, which causes the toner particles to easily detach from the carrier surface and adhere to the electrostatic latent image. As a result, the developing ability of the imaging device including the photoreceptor and the developing device becomes high so as to make the development density excessively dense. Thereafter, when the image forming operation is performed thereafter, the two-component developer is stirred in the developing device, which promotes triboelectric charging of toner. Thus, the toner charge amount (Q/M) starts to increase, but the development density is still rather dense until the toner charge amount (Q/M) reaches a high value to some extent. Therefore, in the image forming operation after the predetermined retention time or more, it is desirable to make the development density appropriate by decreasing the control target value of the toner concentration lower than the actual value to decrease the developing ability.

However, it has been found that, once the development density is made appropriate in the above manner, the image forming apparatus is likely to have a poor development density in future. Specifically, when the image forming operation is performed after the target value correction processing is performed in the state where the toner charge amount (Q/M) has decreased after a long retention time to greatly decrease the control target value of the toner concentration, the toner charge amount (Q/M) of the two-component developer starts increasing to an average value. Since the developing ability will be too low in due time, it is required to raise the developing ability by increasing the control target value of the toner concentration. However, even if the control target value of the toner concentration is increased, it takes a certain period of time for the toner concentration of the two-component developer to increase to the corrected control target value. Since the toner concentration of the two-component developer is much lower than the appropriate value during that period of time, the developing ability is too low to achieve a sufficient development density.

Meanwhile, not only in the case where the image forming operation is performed after a long retention time, but when the control target value of the toner concentration is greatly corrected, it takes a certain period of time for the toner concentration of the two-component developer to reach the same value as the corrected control target value. During that period of time, the development density may be excessive or may be too low. For example, temperature and humidity influence the developing ability of the imaging device. This is because, as temperature or humidity becomes lower, the triboelectric charging property of toner in the two-component developer becomes higher to increase the toner charge amount (Q/M). Therefore, when the temperature and humidity rapidly changes due to, for example, starting of an air conditioner, it is desirable to correct the control target value of the toner concentration according to the temperature and humidity change. However, even though the control target value of the toner concentration is greatly corrected in accordance with the great change in the temperature and humidity, the toner concentration still greatly deviates from the appropriate value until the toner concentration of the two-component developer reaches the corrected control target value. As a result, the development density becomes excessive or too low.

Moreover, the occurrence of a time lag between a great correction of the control target value and the reflection of the correction on practical developing ability of the imaging device is not limited to the correction of the control target value of the toner concentration. For example, it is assumed that the control target value of the laser intensity of a laser optical system that optically writes an electrostatic latent image to a clear background surface (hereinafter just "surface") of the photoreceptor is greatly corrected. In this case, the electric potential of the electrostatic latent image to be written after the control target value of the laser intensity is greatly corrected can be corrected to the target electric potential. However, an electrostatic latent image has already been written on the surface of the photoreceptor before the control target value of the laser intensity is greatly corrected. Specifically, the electrostatic latent image is optically written on an optical writing position at a predetermined position in the circumferential direction of the photoreceptor, and then, as the photoreceptor rotates, the electrostatic latent image enters a development area opposite from the developing device and is developed. In the case where the control target value of the laser intensity is greatly corrected, the electrostatic latent image which has already entered the developing area and the electrostatic latent image which is present between the optical writing position and the development area at the time of correction are written with the uncorrected laser intensity, and therefore, their electric potentials deviate from the target value. As a result, a certain time lag exists from when the control target value of the laser intensity is corrected and until the electrostatic latent image written with the corrected laser intensity is developed, i.e., until the correction is reflected on the practical developing ability of the imaging device. As such, some control parameters of the image forming apparatus cause time lags between when the control target values are corrected and when the corrections are reflected on the actual developing ability of the imaging device.

SUMMARY

In view of the above, it is a general object of the present invention to provide an image forming apparatus that can suppress occurrence of a poor development density from when a control target value of a control parameter is corrected and until the correction is reflected on the practical developing ability of an imaging device.

In order to achieve the above-mentioned object, according to one aspect of the present disclosure, there is provided an image forming apparatus including: an imaging device and a controller. The imaging device includes a latent image carrier to carry a latent image on a surface thereof; a latent image writing device to write the latent image on the surface of the latent image carrier; and a developing device to develop the latent image on the surface of the latent image carrier with toner. The controller, when control target values of control parameters that influence a developing ability of the imaging unit becomes inappropriate, performs target value correction processing of correcting the control target value to bring the control target value close to an appropriate value for stabilizing a development density of the imaging unit. In the target value correction processing, the controller corrects a control target value of a second control parameter having a response speed, obtained when the developing ability is changed by the correction, faster than a first control parameter, corrects the control target value of the first control parameter, and then turns the control target value of the second control parameter back to the original value.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
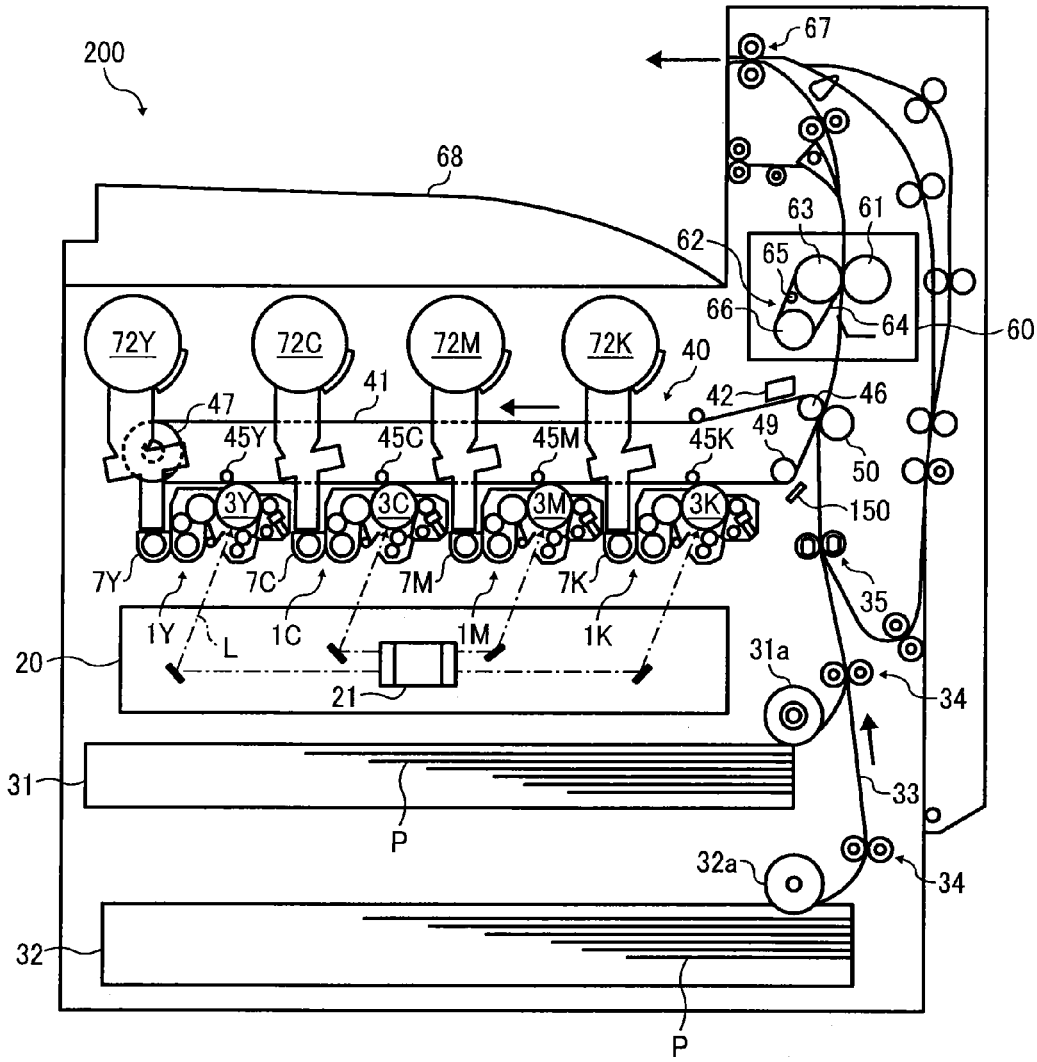
FIG. 1 is a schematic configuration diagram illustrating a printer according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result. Referring now to the drawings, wherein like reference numerals designate identical or corresponding parts throughout the several views thereof, and particularly to FIGS. 1 through 22, an electrophotographic image forming apparatus according to illustrative embodiments of the present disclosure.

An embodiment will be described below in which the present invention is applied to an electrophotographic type printer (hereinafter, simply referred to as "printer") as an image forming apparatus. It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

First, a basic configuration of the printer 200 according to the embodiment will be described. FIG. 1 is a schematic configuration diagram illustrating the printer according to the embodiment. The printer has four imaging units 1Y, 1C, 1M, and 1K for yellow, cyan, magenta, and black (hereinafter, described as Y, C, M, and K). The four imaging units have the same configuration except that toners used as image forming materials are in different colors of Y, C, M, and K.

Figure 2:
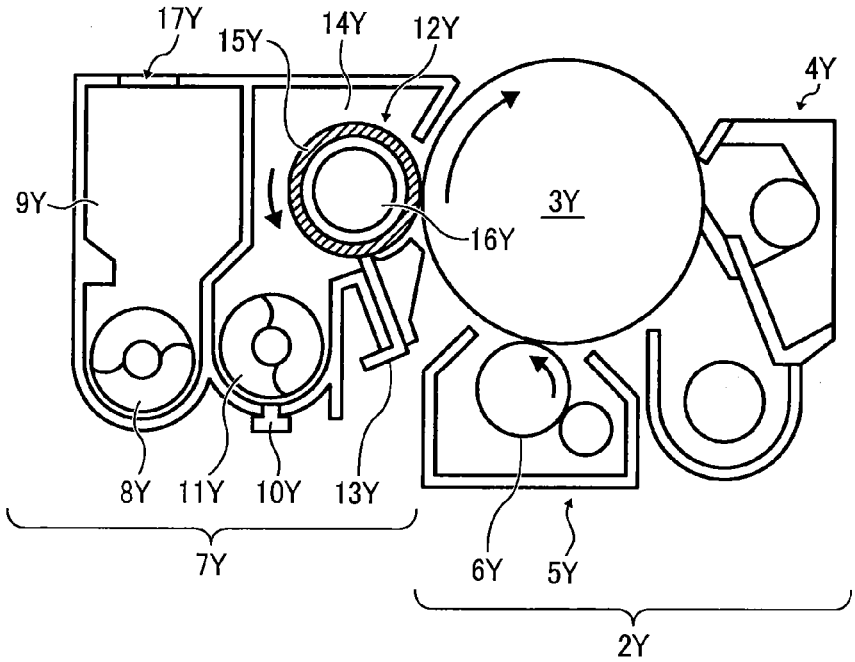
FIG. 2 is an enlarged schematic diagram illustrating an enlarged imaging unit which is for imaging a Y toner image in the printer.
Figure 3:
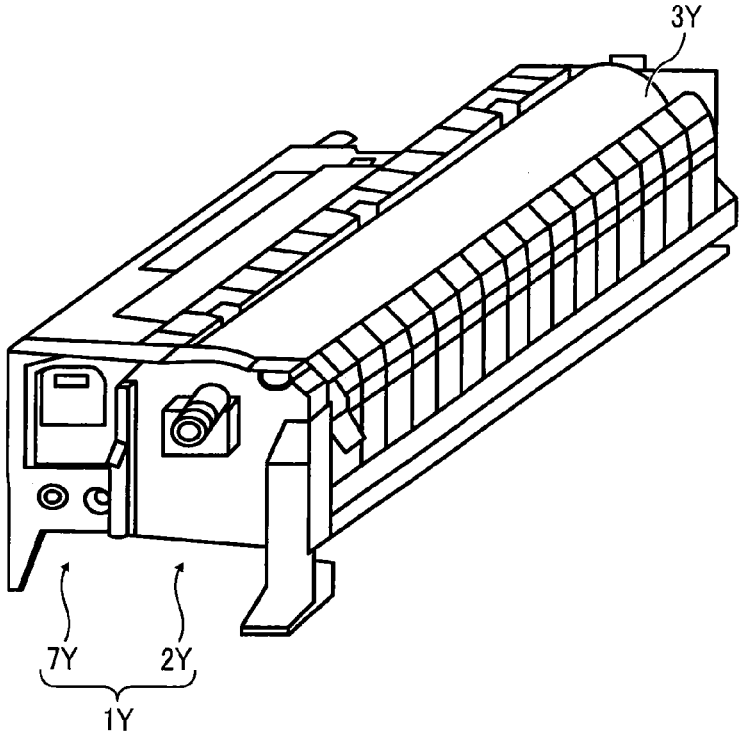
FIG. 3 is a perspective view illustrating an appearance of the imaging unit.

FIG. 2 is a schematic diagram illustrating a configuration of the imaging unit 1Y, which is for imaging a Y toner image. FIG. 3 is a perspective view illustrating an appearance of the imaging unit 1Y. In the figures, the imaging unit 1Y has a photoreceptor unit 2Y and a developing unit 7Y. As illustrated in FIG. 3, the photoreceptor unit 2Y and the developing unit 7Y are integrated into the imaging unit 1Y, which can be attached to and detached from a main body of the printer 200 as one body. When the imaging unit 1Y is detached from the main body of the printer 200, the developing unit 7Y can be attached to and detached from the photoreceptor unit (not shown).

The photoreceptor unit 2Y includes a drum-shaped photoreceptor 3Y as a latent image carrier, a drum cleaning device 4Y, a charge-eliminating device (not shown), and a charging device 5Y. The charging device 5Y as a charging unit uniformly charges the surface of the photoreceptor 3Y by a charging roller 6Y while the photoreceptor 3Y is rotated by a driving unit (not shown) in the clockwise direction of FIG. 2. Specifically, in FIG. 2, a charging bias is applied from a power source (not shown) to the charging roller 6Y while the charging roller 6Y is rotated counterclockwise, so that the charging roller 6Y moves close to or comes into contact with the photoreceptor 3Y to uniformly charge the photoreceptor 3Y.

Instead of the charging roller 6Y, a component for moving another charging member such as a charge brush close to or into contact with the photoreceptor 3Y may be used. A component for uniformly charging the photoreceptor 3Y by means of a charger such as a scorotron charger may also be used. The surface of the photoreceptor 3Y which is uniformly charged by the charging device 5Y is exposure-scanned by a laser beam emitted from an optical writing unit 20 as a latent image writing device, to be described later, and a Y-electrostatic latent image is carried on the surface.

Figure 4:
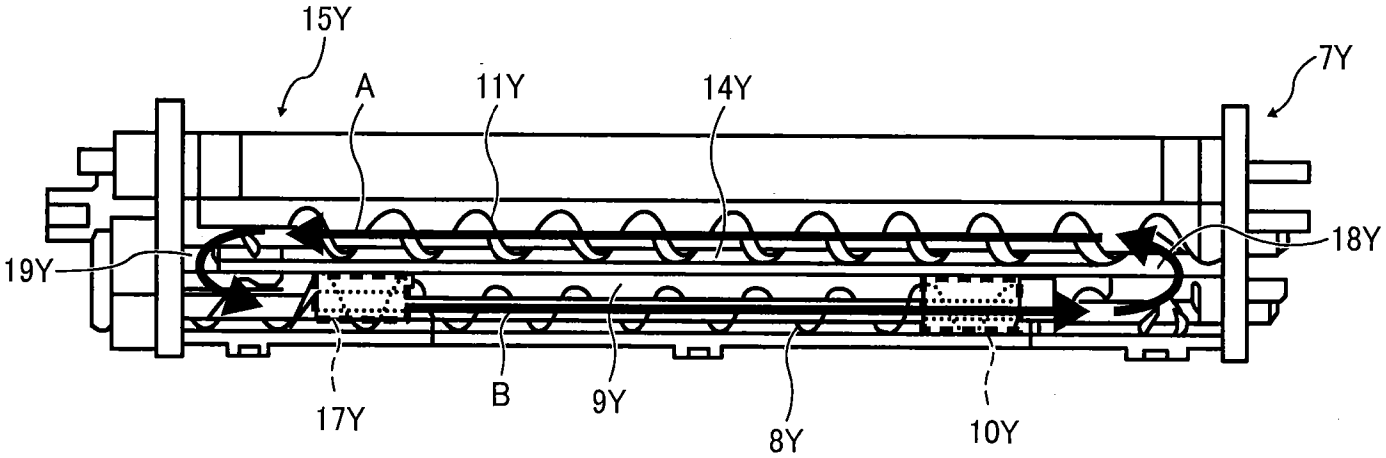
FIG. 4 is an exploded plan view illustrating a developing unit of the imaging unit.

FIG. 4 is an exploded plan view showing the inside of the developing unit 7Y. As illustrated in FIGS. 2 and 4, the developing unit 7Y as a developing device has a first developer storage chamber 9Y in which a first conveying screw 8Y as a developer conveyor is disposed. The developing unit 7Y also has a second developer storage chamber 14Y in which a toner concentration sensor 10Y as a toner concentration detector configured by a permeability sensor, a second conveying screw 11Y as the developer conveyor, a developing roll 12Y as a developer carrier, and a doctor blade 13Y as a developer regulating member are disposed.

These two developer storage chambers forming a circulation path contain a Y-developer (not shown) which is a two-component developer including a magnetic carrier and a negatively charged Y-toner. The first conveying screw 8Y conveys the Y-developer in the first developer storage chamber 9Y to this side of FIG. 2 (in the direction indicated by an arrow B in FIG. 4) while being rotated by a driving unit (not shown). The toner concentration sensor 10Y fixed above the first conveying screw 8Y detects toner concentration of the Y-developer when the conveyed Y-developer passes the predetermined detector 10Y located downstream of the direction of the developer circulation path from a part opposite to a toner supply port 17Y (hereinafter, referred to as "supplying position") in the first developer storage chamber 9Y. Then, the Y-developer conveyed by the first conveying screw 8Y to an end of the first developer storage chamber 9Y enters the second developer storage chamber 14Y through a communication port 18Y.

The second conveying screw 11Y in the second developer storage chamber 14Y conveys the Y-developer to the far side of FIG. 2 (in the direction indicated by an arrow A in FIG. 4) while being rotated by a driving unit (not shown). Above the second conveying screw 11Y that conveys the Y-developer in this manner, the developing roll 12Y is disposed in parallel with the second conveying screw 11Y. The developing roll 12Y contains a magnet roller 16Y which is disposed inside of and fixed to a developing sleeve 15Y. The developing sleeve 15Y is made of a non-magnetic sleeve and is rotated counterclockwise in FIG. 2.

The Y-developer being conveyed by the second conveying screw 11Y is partly drawn up to the surface of the developing sleeve 15Y by the magnetic force of the magnet roller 16Y. The developer drawn up on the surface of the developing sleeve 15Y has its thickness regulated by the doctor blade 13Y which is disposed to maintain a predetermined gap with the surface of the developing sleeve 15Y. Then, the developer is conveyed to the development area which is opposite to the photoreceptor 3Y, and the Y-toner adheres to a Y-electrostatic latent image on the photoreceptor 3Y. After the adhesion, the Y-toner image is formed on the photoreceptor 3Y. The Y-developer which has consumed the Y-toner in the development is returned to the second conveying screw 11Y following rotation of the developing sleeve 15Y. Then, the Y-developer conveyed by the second conveying screw 11Y to an end of the second developer storage chamber 14Y returns to the inside of the first developer storage chamber 9Y through a communication port 19Y. In this manner, the Y-developer is circulated and conveyed in the developing unit.

The detected result of the toner concentration of the Y-developer by the toner concentration sensor 10Y is sent to a control device (not shown) as an electric signal. The control device converts the output voltage from the toner concentration sensor 10Y into the toner concentration of the Y-developer, and stores it in a RAM. Also, the control device converts the output voltages from the toner concentration sensors (10C, 10M, 10K) which are mounted to the developing units for C, M, and K (7C, 7M, 7K) into the toner concentrations of the respective developers (C-, M-, and K-developers). Note that the output voltage from the toner concentration sensor configured by a permeability sensor correlates with the toner concentration. As the toner concentration of the developer becomes higher, the permeability of the developer decreases and the output value from the toner concentration sensor decreases.

In the case of the Y-developing unit 7Y, the control device compares a detected result of the toner concentration that is calculated based on the output voltage from the toner concentration sensor 10Y with a control target value of the Y-toner concentration stored in the RAM. Then, in order to supply the Y-toner from the toner supply port 17Y by the amount corresponding to the comparison result, the control device drives a Y-supply motor of the toner supply device 70 (see FIGS. 8 and 9) for a period of time corresponding to the amount. As a result, an appropriate amount of Y-toner is supplied in the first developer storage chamber 9Y to the Y-developer having the Y-toner concentration decreased by the consumption of the Y-toner in the development. As a result, the toner concentration of the Y-developer in the second developer storage chamber 14Y is maintained around the target value of the toner concentration. This is also the case for the developers in the developing units for the other colors 7C, 7M, and 7K.

The Y-toner image formed on the photoreceptor 3Y in FIG. 1 is transferred to an intermediate transfer belt 41 that is an intermediate transfer member. The drum cleaning device 4Y of the photoreceptor unit 2Y removes the toner remaining on the surface of the photoreceptor 3Y after the intermediate transfer process. As a result, the surface of the photoreceptor 3Y subjected to the cleaning process has the charge eliminated by the charge-eliminating device (not shown). Through the charge elimination, the surface of the photoreceptor 3Y is initialized and prepared for the next image forming. Also in the imaging units for the other colors 1C, 1M, and 1K, similarly, the C-toner image, the M-toner image, and the K-toner image are formed on the photoreceptors 3C, 3M, and 3K and transferred to the intermediate transfer belt 41.

The optical writing unit 20 is disposed below the imaging units 1Y, 1C, 1M, and 1K. The optical writing unit 20 radiates the photoreceptors 3Y, 3C, 3M, and 3K of the respective imaging units 1Y, 1C, 1M, and 1K with a laser beam L emitted based on the image information. As a result, the Y-, C-, M-, and K-electrostatic latent images are formed on the photoreceptors 3Y, 3C, 3M, and 3K, respectively.

The optical writing unit 20 radiates the photoreceptors 3Y, 3C, 3M, and 3K via a plurality of optical lenses and mirrors with the laser beam L emitted from a light source, while deflecting the laser beam L by using a polygon mirror 21 rotated by a motor. In place of the above configuration, a configuration employing an LED array may be used.

Below the optical writing unit 20, a first paper feeding cassette 31 and a second paper feeding cassette 32 are disposed spaced apart from one another in the vertical direction. Each of the paper feeding cassettes accommodates a plurality of recording sheets P as recording materials stacked in the form of a bundle of recording sheets. A first paper feeding roller 31*a* and a second paper feeding roller 32*a* come into contact with the respective topmost recording sheets P. While the first paper feeding roller 31*a* is rotated counterclockwise in FIG. 1 by a driving unit (not shown), the topmost recording sheet P in the first paper feeding cassette 31 is discharged onto a paper feeding path 33 which is disposed at the right side of the cassettes to extend in the vertical direction in FIG. 1. While the second paper feeding roller 32*a* is rotated counterclockwise in FIG. 1 by a driving unit (not shown), the topmost recording sheet P in the second paper feeding cassette 32 is discharged onto the paper feeding path 33.

A plurality of pairs of conveying rollers 34 are disposed in the paper feeding path 33, so that the recording sheet P sent to the paper feeding path 33 is vertically conveyed upward from the bottom of the paper feeding path 33 while being sandwiched between the pairs of conveying rollers 34.

A pair of resist rollers 35 are disposed at the end of the paper feeding path 33. As soon as the pair of resist rollers 35 sandwich the recording sheet P sent from the pairs of conveying rollers 34, rotation of both rollers are once stopped. Then, the recording sheet P is sent to a secondary transfer nip (described later) at an appropriate timing.

Above the imaging units 1Y, 1C, 1M, and 1K, a transfer unit 40 is disposed to extend and endlessly move the intermediate transfer belt 41 counterclockwise. The transfer unit 40 includes not only the intermediate transfer belt 41 but also a belt-cleaning unit 42, a first bracket (not shown), and a second bracket (not shown). The transfer unit 40 also includes four primary transfer rollers 45Y, 45C, 45M, and 45K, a secondary transfer backup roller 46, a drive roller 47, an auxiliary roller (not shown), and a nip inlet roller 49. The intermediate transfer belt 41 is extended between these rollers while it is endlessly moved counterclockwise in FIG. 1 by the rotation of the drive roller 47.

The four primary transfer rollers 45Y, 45C, 45M, and 45K and the photoreceptors 3Y, 3C, 3M, and 3K form primary transfer nips, respectively, by sandwiching the endlessly moving intermediate transfer belt 41 therebetween. A transfer bias in the polarity opposite to the toner (positive polarity in the present embodiment) is applied to the inner peripheral surface of the intermediate transfer belt 41. While the intermediate transfer belt 41 sequentially passes through the Y-primary transfer nip, the C-transfer nip, the M-transfer nip, and the K-transfer nip in order during the endless movement, the toner images of the respective colors on the photoreceptors 3Y, 3C, 3M, and 3K are primary-transferred to the circumference surface of the intermediate transfer belt 41 to be superimposed on each other. As a result, four colored toner images superimposed on each other (hereinafter, referred to as "four-color toner images") are formed on the intermediate transfer belt 41.

The secondary transfer backup roller 46 forms a secondary transfer nip with a secondary transfer roller 50 disposed on the outside of the loop of the intermediate transfer belt 41 by sandwiching the intermediate transfer belt 41 therebetween. The pair of resist rollers 35 described above send out the recording sheet P sandwiched therebetween to the secondary transfer nip at the timing at which the arrival of the recording sheet P is synchronized with the arrival of four-color toner images formed on the intermediate transfer belt 41. The four-color toner images on the intermediate transfer belt 41 are collectively secondarily transferred to the recording sheet P in the secondary transfer nip under the influence of a secondary transfer electric field formed between the secondary transfer roller 50 and the secondary transfer backup roller 46, to which the secondary transfer bias is applied, and the influence of nip pressure. As a result, a full-color toner image is created in combination with the white color of the recording sheet P.

The leftover toner that has not been transferred to the recording sheet P is adhered onto the intermediate transfer belt 41 that has passed through the secondary transfer nip. The leftover toner is cleaned by the belt-cleaning unit 42. The belt-cleaning unit 42 has a cleaning blade 42*a* in contact with the front surface of the intermediate transfer belt 41 for scraping off the toner left on the belt 41.

The first bracket (not shown) of the transfer unit 40 is configured to swing about an axis of rotation of the auxiliary roller (not shown) at a predetermined rotation angle according to on/off of drive of a solenoid (not shown).

In the case of forming a monochrome image, in the printer 200 of the present embodiment, the first bracket (not shown) is slightly rotated counterclockwise in the figure by the above drive of the solenoid. With this rotation, the Y-, C-, and M-primary transfer rollers 45Y, 45C, and 45M are revolved about the axis of rotation of the auxiliary roller (not shown) counterclockwise in the figure to separate the intermediate transfer belt 41 from the Y-, C-, and M-photoreceptors 3Y, 3C, and 3M. Then, only the K-imaging unit 1K is driven among the four imaging units 1Y, 1C, 1M, and 1K to form the monochrome image. Therefore, wear of the Y-, C-, and M-imaging units due to unnecessary driving of the imaging units in forming a monochrome image can be prevented.

A fixing unit 60 as a fixing device is disposed above the secondary transfer nip in the figure. The fixing unit 60 includes a pressure heating roller 61 that contains a heat source such as a halogen lamp, and a fixing belt unit 62. The fixing belt unit 62 has a fixing belt 64, a heating roller 63 which contains a heat source such as a halogen lamp, a tension roller 65, a drive roller 66, a temperature sensor (not shown), and the like. The fixing belt unit 62 endlessly moves the endless fixing belt 64 counterclockwise in FIG. 2 while extending the endless fixing belt 64 by the tension roller 65 and the drive roller 66. In the process of the endless movement, the fixing belt 64 is heated by the heating roller 63 from the backside.

The pressure heating roller 61 is in contact with the front surface of a part of the fixing belt 64 that is hung on the heating roller 63 and is rotated clockwise in FIG. 1. As a result, a fixing nip is formed in which the pressure heating roller 61 and the fixing belt 64 come into contact with each other.

The temperature sensor (not shown) is disposed at the outside of the loop of the fixing belt 64 to face the fixing belt 64 at a predetermined space from the front surface of the fixing belt 64 for detecting the surface temperature of the fixing belt 64 immediately before the fixing belt 64 enters the fixing nip. The detected result is sent to a fixing power supply circuit (not shown). The fixing power supply circuit controls on/off of the power supply to the heat source contained in the heating roller 63 and the heat source contained in the pressure heating roller 61 based on the detected result from the temperature sensor. As a result, the surface temperature of the fixing belt 64 is maintained to 140° C.

The recording sheet P that has passed the secondary transfer nip is separated from the intermediate transfer belt 41 and then sent into the fixing unit 60. While the recording sheet P is conveyed upward from the bottom in the figure as it is held between the fixing nip in the fixing unit 60, a full-color toner image is heated and pressed by the fixing belt 64 to be fixed on the recording sheet P.

The recording sheet P subjected to the above-described fixing process is conveyed between a pair of paper output rollers 67 to be discharged outside the printer 200. A stacking member 68 is formed on the top of the casing of the body of the printer 200, so that the recording sheets P discharged outside the printer 200 by the pair of paper output rollers 67 are sequentially stacked in the stacking member 68.

Toner bottles 72Y, 72C, 72M, and 72K that are four toner containers for containing the Y-toner, the C-toner, the M-toner, and the K-toner, respectively, are disposed above the transfer unit 40. The toner of each color in the toner bottles 72Y, 72C, 72M, and 72K is supplied as necessary to each of the developing units 7Y, 7C, 7M, and 7K of the imaging units 1Y, 1C, 1M, and 1K by the toner supply device 70. The toner bottles 72Y, 72C, 72M, and 72K can be attached to and detached from the body of the printer 200 independently from the imaging units 1Y, 1C, 1M, and 1K.

In FIG. 4, the toner concentration sensor 10Y detects the toner concentration of the developer in the first developer storage chamber 9Y immediately before the developer enters the second developer storage chamber 14Y. The toner supply port 17Y is provided at the position where the toner is supplied to the developer immediately after the developer entered the first developer storage chamber 9Y from the second developer storage chamber 14Y. That is, in the first developer storage chamber 9Y, the toner concentration sensor 10Y detects the toner concentration of the developer at a position downstream from the toner supply port 17Y.

Figure 5:
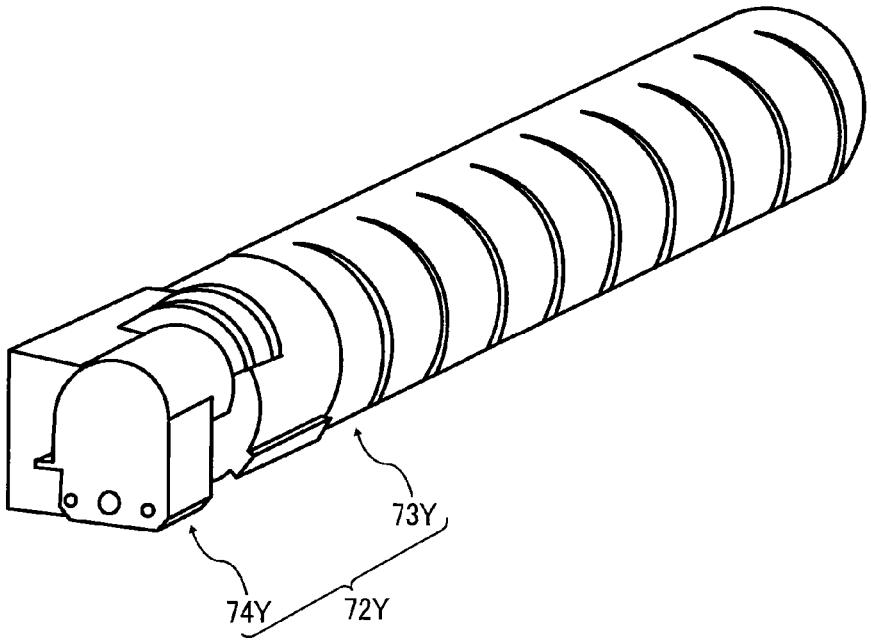
FIG. 5 is a perspective view illustrating a Y toner bottle in the printer.

FIG. 5 is a perspective view illustrating the Y-toner bottle 72Y. In the figure, the Y-toner bottle 72Y has a bottle-shaped bottle body 73Y that is a powder chamber for containing the powdered Y-toner (not shown) and a cylindrical holder 74Y which functions as a powder discharging member.

Figure 6:
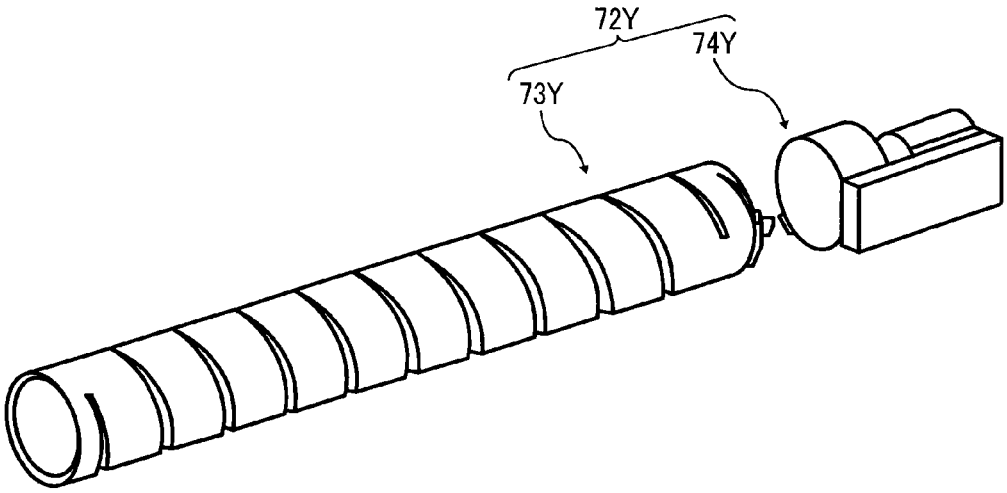
FIG. 6 is a perspective view illustrating the toner bottle disassembled into a bottle body and a holder.

As illustrated in FIG. 6, the holder 74Y is engaged with the head of the bottle-shaped bottle body 73Y to rotatably hold the bottle body 73Y. On the inner peripheral surface of the bottle body 73Y, a screw-shaped helical thread protruding inward from the outer side of the container is formed to extend in the axis direction of the bottle.

Figure 7:
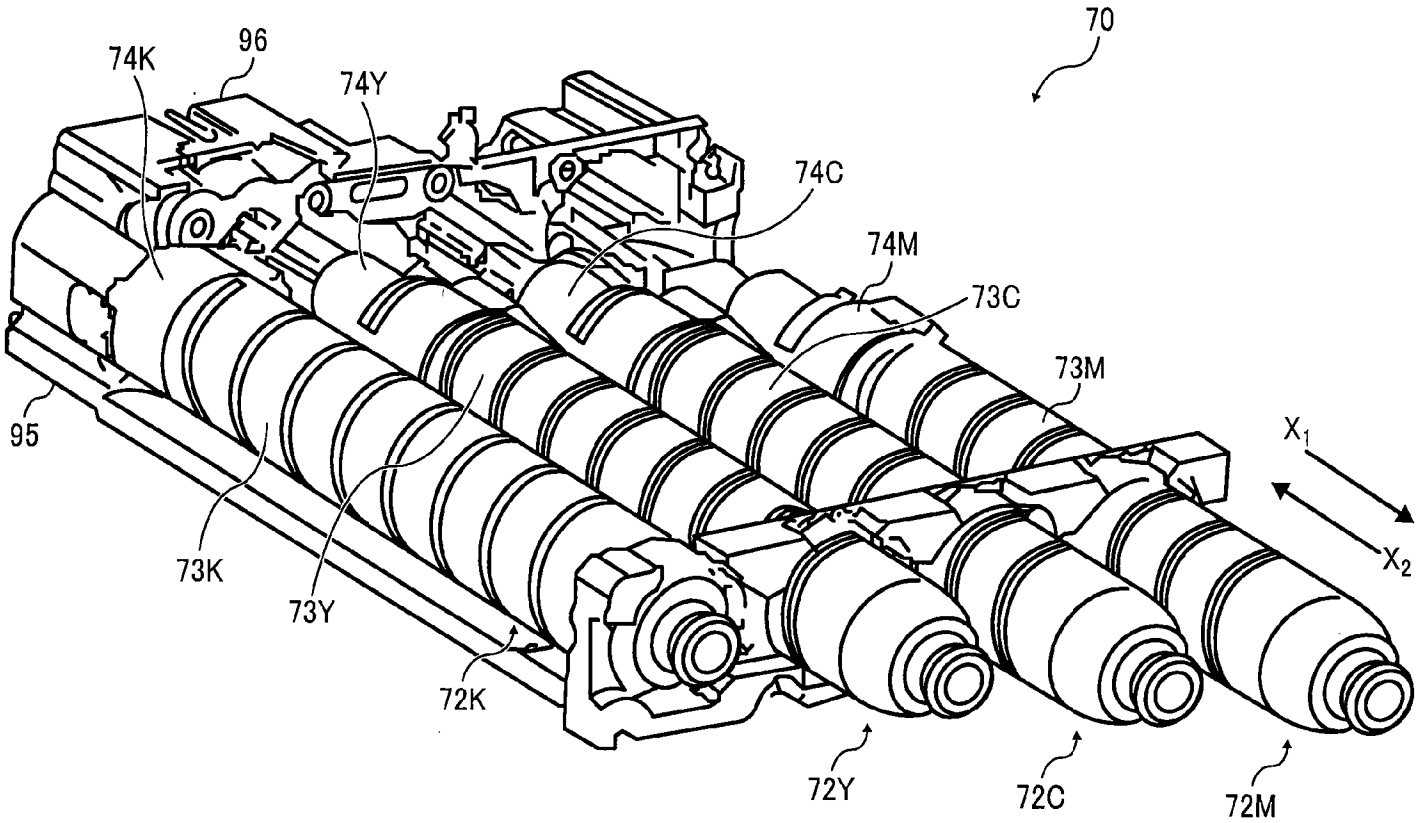
FIG. 7 is a perspective view illustrating a toner supply device of the printer.

FIG. 7 is a perspective view illustrating the toner supply device 70 of the present printer 200. In the figure, the toner supply device 70 as a toner supply unit has a bottle mounting table 95 for mounting the four toner bottles 72K, 72Y, 72C, and 72M, and a bottle driving mechanism 96 for rotating the respective bottle bodies 73K, 73Y, 73C, and 73M independently from each other. The toner bottles 72K, 72Y, 72C, and 72M set on the bottle mounting table 95 have their holder (bottle holder, left side shown in FIG. 7) engaged with the bottle driving mechanism 96 respectively.

As shown by an arrow X1 in FIG. 7, when the toner bottle 72M engaged with the bottle driving mechanism 96 is slid on the bottle mounting table 95 away from the bottle driving mechanism 96, the holder 74M of the toner bottle 72M comes off from the bottle driving mechanism 96. In this manner, the toner bottle 72M can be detached from the toner supply device 70.

On the other hand, in the toner supply device 70 to which the toner bottle 72M is not attached, as shown by an arrow X2 in FIG. 7, when the toner bottle 72M is slid on the bottle mounting table 95 toward the bottle driving mechanism 96, the holder 74M of the toner bottle 72M is engaged with the bottle driving mechanism 96. In this manner, the toner bottle 72M can be attached to the toner supply device 70. Also in the case of the toner bottles for the other colors 72K, 72Y, and 72C, the toner bottles can be attached to and detached from the toner supply device 70 by the same operation.

Gears (not shown) are formed on the circumference surfaces of the heads of the bottle bodies 73K, 73Y, 73C, and 73M of the toner bottles 72Y, 72C, 72M, and 72K, respectively, and the gears are covered by the holders 74K, 74Y, 74C, and 74M. However, apertures (not shown) for partially exposing the gears are formed on portions of the circumference surfaces of the holders 74K, 74Y, 74C, and 74M, respectively, and the gears are partially exposed from the apertures.

When the holders 74K, 74Y, 74C, and 74M of the toner bottles 72K, 72Y, 72C, and 72M are engaged with the K-, Y-, C-, and M-bottle driving gears (not shown) provided in the bottle driving mechanism 96 are meshed with gears of the bottle bodies 73K, 73Y, 73C, and 73M through the above-described apertures. In response to rotation of the K-, Y-, C-, and M-bottle driving gears of the bottle driving mechanism 96 by a drive system (not shown), the bottle bodies 73K, 73Y, 73C, and 73M are rotated on the holders 74K, 74Y, 74C, and 74M.

In FIG. 5, when the bottle body 73Y is rotated on the holder 74Y in this manner, the Y-toner in the bottle body 73Y moves from the bottom of the bottle 72Y toward the head of the bottle 72Y along the screw-shaped helical thread protrusion described above. Then, the Y-toner flows into the cylindrical holder 74Y through a bottle opening (not shown) provided on the tip of the bottle body 73Y, which is a containing unit for containing powder.

Figure 8:
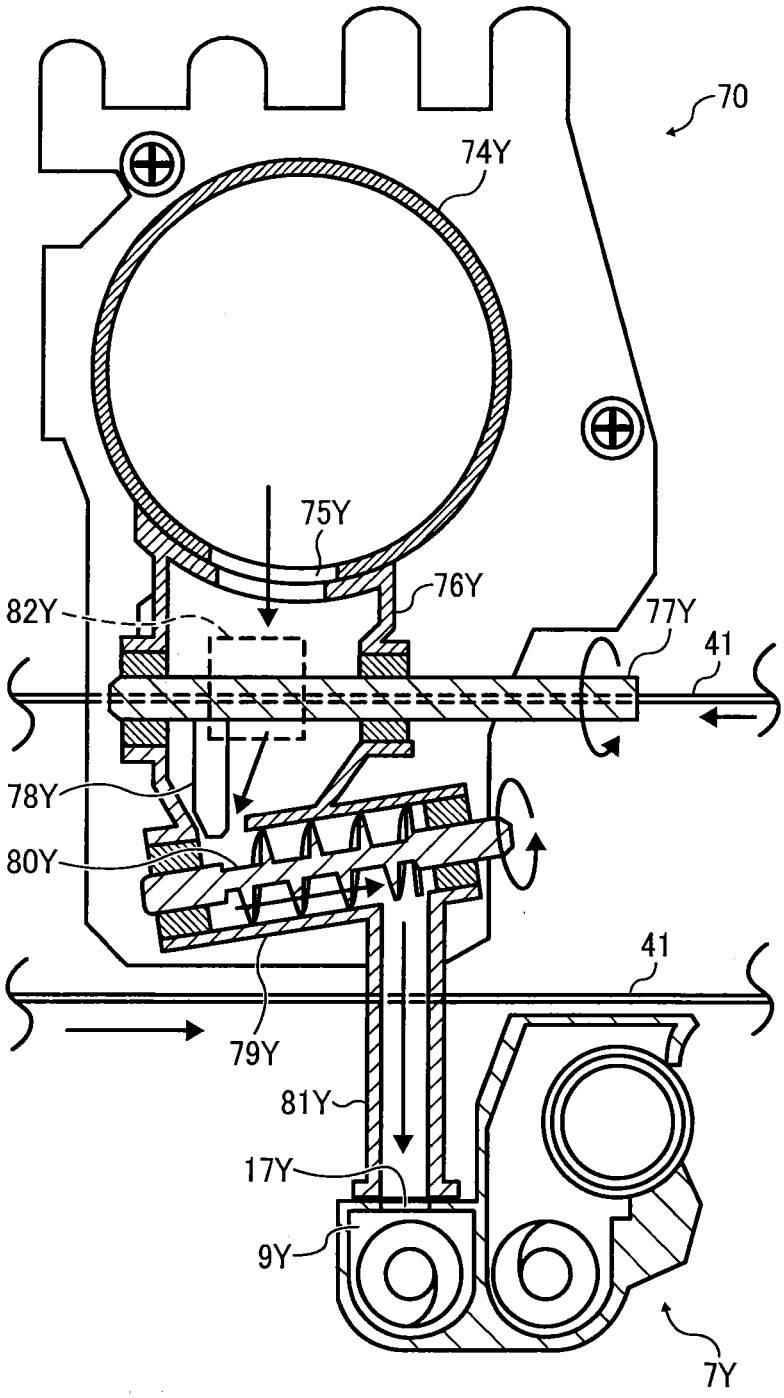
FIG. 8 is a schematic configuration diagram illustrating the toner bottle attached to the toner supply device and a configuration around the toner bottle.

FIG. 8 is a schematic configuration diagram illustrating the toner bottle attached to the toner supply device 70 and a configuration around the toner bottle 72Y. In the figure, a cross-section of the toner bottle that is cut away at the holder 74Y is illustrated. As described above, when the bottle body 73Y (not shown in FIG. 8) located farther than the holder 74Y in the figure is rotated by the driving unit, the Y-toner in the bottle body 73Y is sent into the holder 74Y.

The holder 74Y of the toner bottle 72Y is engaged with a hopper 76Y of the toner supply device 70. The hopper 76Y formed in a flat shape perpendicular to the plane of drawing is located closer to this side than the intermediate transfer belt 41 in the figure. A toner discharge port 75Y formed on the bottom of the holder 74Y and a toner receiving port formed on the hopper 76Y of the toner supply device 70 communicate with each other.

The Y-toner sent from the bottle body 73Y into the holder 74Y of the toner bottle 72Y falls into the hopper 76Y by its own weight. In the hopper 76Y, a highly flexible pressure film 78Y fixed to a rotatable rotational shaft member 77Y rotates together with the rotational shaft member 77Y. A toner detection sensor 82Y configured by a piezoelectric element which detects the presence or absence of the Y-toner in the hopper 76Y is fixed to the inner wall of the hopper 76Y.

While the pressure film 78Y made of polyethylene terephthalate (PET) rotates, it presses the Y-toner against a detection surface of the toner detection sensor 82Y. Consequently, the toner detection sensor 82Y can successfully detect the toner in the hopper 76Y. The rotation drive control of the bottle body 73Y of the toner bottle 72Y is performed so that the toner detection sensor 82Y successfully detects the Y-toner. Therefore, as far as the bottle body 72Y contains a sufficient amount of the Y-toner, a sufficient amount of the Y-toner falls from the bottle body 73Y through the holder 74Y into the hopper 76Y to fill the hopper 76Y with the sufficient amount of the Y-toner. If the above state changes into a state in which the Y-toner is hardly detected by the toner detection sensor 82Y even though the bottle body 73Y is frequently rotated, the control device (not shown) determines that only little amount of the Y-toner is left in the bottle body 73Y and sends a warning of "Toner Near End" to a user.

Since a horizontal carrier pipe 79Y is connected to the lower part of the hopper 76Y, the Y-toner in the hopper 76Y slides down the taper and falls into the horizontal carrier pipe 79Y by its own weight.

A toner supply screw 80Y is disposed in the horizontal carrier pipe 79Y, and with the rotation of the toner supply screw 80Y, the Y-toner is horizontally carried through the horizontal carrier pipe 79Y.

A drop guiding pipe 81Y vertically extends to connect with an end of the longitudinal direction of the horizontal carrier pipe 79Y. The lower end of the drop guiding pipe 81Y is connected to the toner supply port 17Y of the first developer storage chamber 9Y of the developing unit 7Y. When the toner supply screw 80Y in the horizontal carrier pipe 79Y rotates, the Y-toner which has already been conveyed to the end of the longitudinal direction of the horizontal carrier pipe 79Y falls into the first developer storage chamber 9Y of the developing unit 7Y through the drop guiding pipe 81Y and the toner supply port 17Y. As a result, the Y-toner is supplied to the first developer storage chamber 9Y. The toners of the other colors (C, M, K) are also supplied in the same manner.

Figure 9:
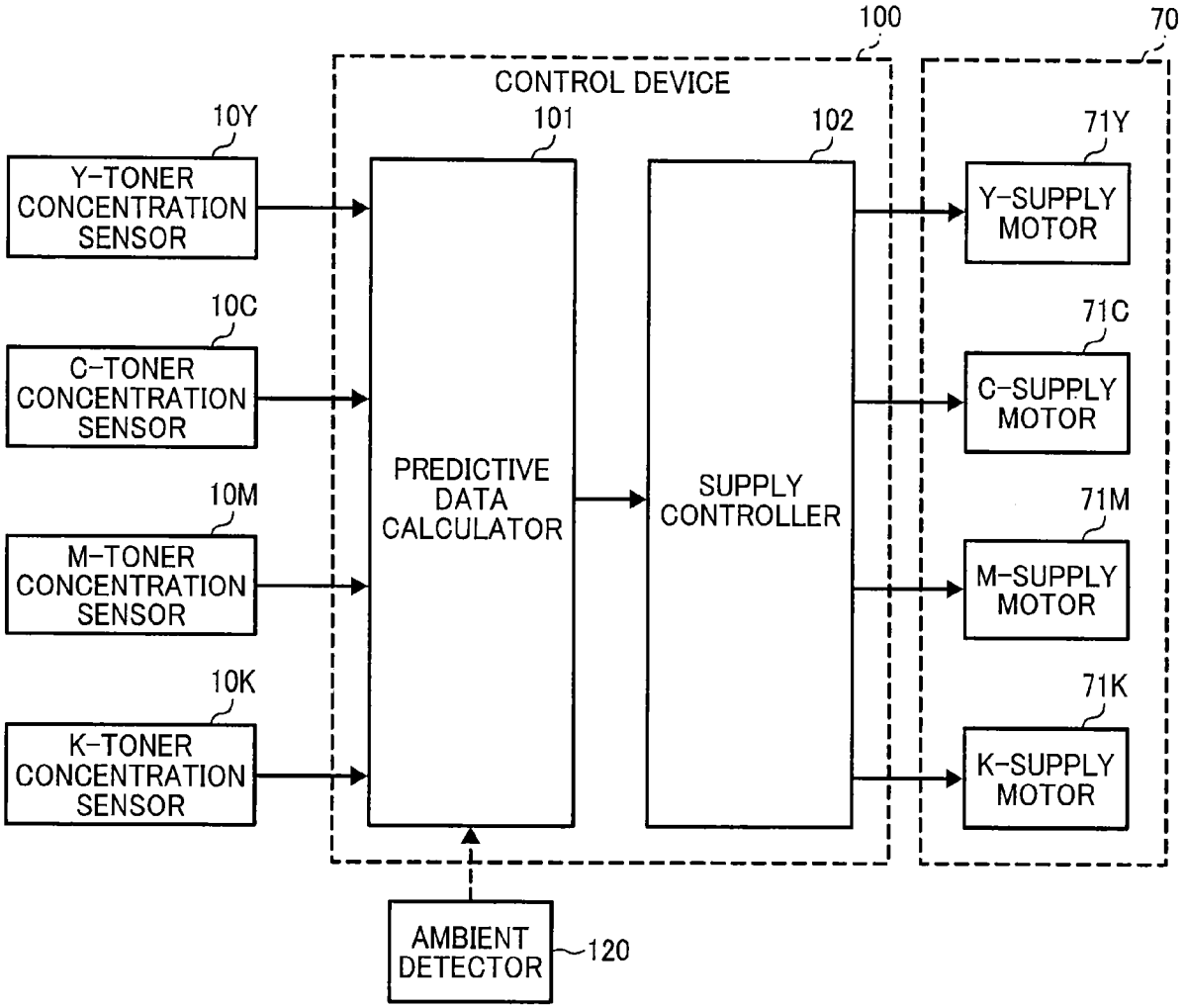
FIG. 9 is a block diagram illustrating a part of an electrical circuit of the printer.

FIG. 9 is a block diagram illustrating a part of an electrical circuit of the present printer 200. A control device 100, which functions as a supply controller, performs adjustment of the supply amounts of the Y-, C-, M-, and K-toners by controlling drive of the Y-, C-, M-, and K-supply motors 71Y, 71C, 71M, and 71K. As the toner supply member, publicly known techniques may be widely used as far as the toner supply amount from the toner supply port (for example, 17Y) into the developing unit can be adjusted by the driving force of the supply motor (for example, 71Y).

The control device 100 includes a CPU (Central Processing Unit) as an arithmetic unit, a RAM (Random Access Memory) as a data storage unit, and a ROM (Read Only Memory), and is capable of performing various types of arithmetic processing and executing control programs. The control device 100 stores control target values of the toner concentrations for Y, C, M, and K in the RAM, respectively.

A supply controller 102 of the control device 100 controls drive of the supply motors for the respective colors (71Y, 71C, 71M, and 71K) in the toner supply device 70 based on predicted data calculated by a predicted data calculator 101. Based on the toner concentration detected result by the toner concentration sensors (10Y, 10C, 10M, and 10K) and the control target values of the toner concentrations, and by using the calculation programs and calculation tables stored in the ROM, the predicted data calculator 101 calculates the predicted data about time variation of the toner concentration of the developer.

Figure 10:
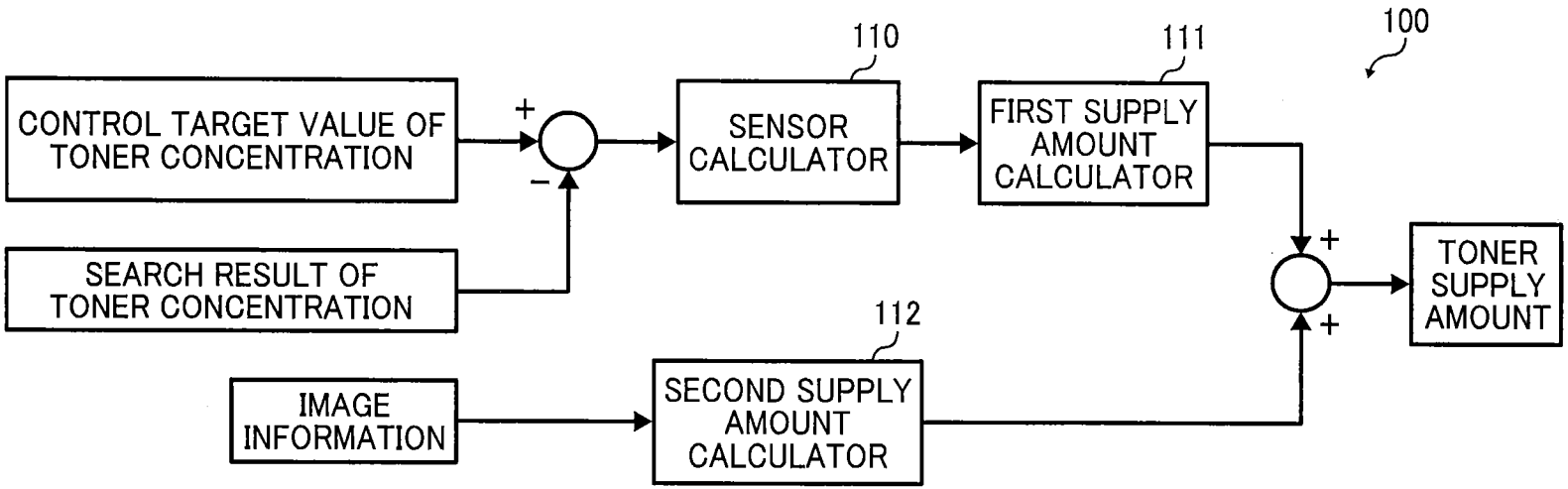
FIG. 10 is a block diagram for describing a process of determining a toner supply amount which is implemented by a control device of the printer from the viewpoint of the circuit.

FIG. 10 is a block diagram for describing a process of determining a toner supply amount that is implemented by the control device 100 from the viewpoint of the circuit. Actually, the control device 100 determines the toner supply amount by the arithmetic processing, but the process of the arithmetic processing will be described from the viewpoint of the circuit to facilitate understanding. The control device 100 compares the control target value of the toner concentration with the detected result of the toner concentration, and controls drive of the supply motor (for example, 71Y) to supply the toner by amount corresponding to the comparison result through the toner supply port (for example, 17Y) into the developing unit (for example 7Y). By this control, an appropriate amount of toner is supplied in the first developer storage chamber (for example, 9Y) of the developing unit 7 to the developer in which the toner concentration is decreased by the consumption of the toner in the development. As a result, the toner concentration of the developer in the second developer storage chamber (for example, 14Y) is maintained around the control target value.

First, in the control device 100, the detected result of the toner concentration is compared with the control target value of the toner concentration and the comparison result is input to a sensor calculator 110. Then, based on the comparison result and the like, the toner supply amount for canceling the difference between the detected result of the toner concentration and the control target value of the toner concentration is calculated by a first supply amount calculator 111. Since the development is continuously performed during a continuous printing operation, supplying the toner only by the amount corresponding to the above toner supply amount is not enough to match the toner concentration to the control target value. Therefore, the toner supply amount for compensating the toner consumption in the development is calculated by a second supply amount calculator 112 based on information about an image to be output such as image information and information of the sheet of paper. The sum of the toner supply amount calculated by the first supply amount calculator 111 and the toner supply amount calculated by the second supply amount calculator 112 is calculated as the final toner supply amount.

Figure 11:
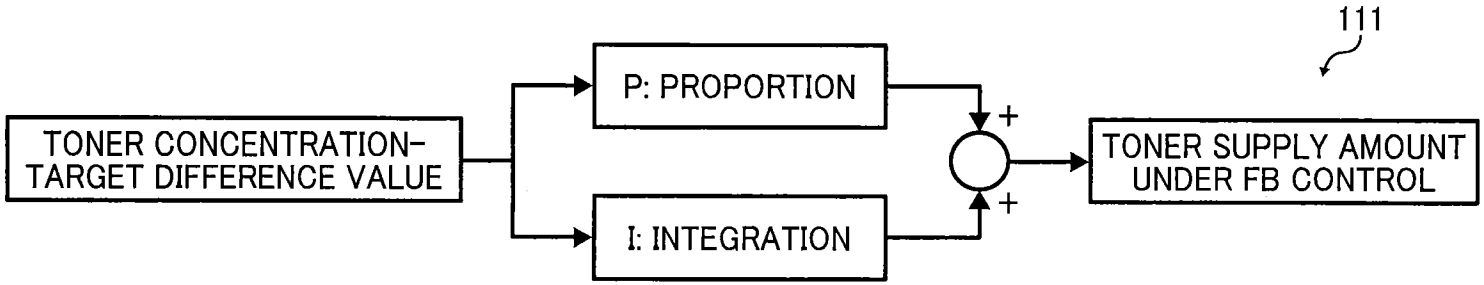
FIG. 11 is a block diagram for describing arithmetic processing executed by a first supply amount calculator of FIG. 10 from the viewpoint of the circuit.

FIG. 11 is a block diagram for describing the arithmetic processing executed by the first supply amount calculator 111 from the viewpoint of the circuit. FIG. 11 shows an example of calculating the toner supply amount by PI control. A toner concentration-target difference value that is a difference between the control target value of the toner concentration and the detected result of the toner concentration is input to the first supply amount calculator 111. As the toner concentration-target difference value is larger, the toner concentration value is farther from the control target value. The toner concentration-target difference value is input to a proportion processor (P) and an integration processor (I). Then, in the proportion processor (P), the toner concentration-target difference value is multiplied by a predetermined gain. From the multiplication, the value of the toner supply amount corresponding to the toner concentration difference value is obtained. On the other hand, in the integration processor (I), the integrated value that is an accumulation of the toner concentration-target difference value is obtained. In the case where the toner concentration-target difference value at a certain timing is significantly large, the integrated value also becomes large, therefore, a large value is calculated for the toner supply amount. Consequently, the toner concentration is recovered promptly. When the toner supply amount is appropriate, the integrated value promptly decreases. In the first supply amount calculator 111, the sum of the toner supply amount calculated by the proportion processor (P) and the toner supply amount calculated by the integration processor (I) is calculated as the toner supply amount by FB (feedback) control. Note that the calculation method is not limited to the PI control, but any calculation method using other control may be used as far as the toner supply amount corresponding to a difference from an input and the toner supply amount corresponding to accumulation of difference are reflected.

Figure 12:
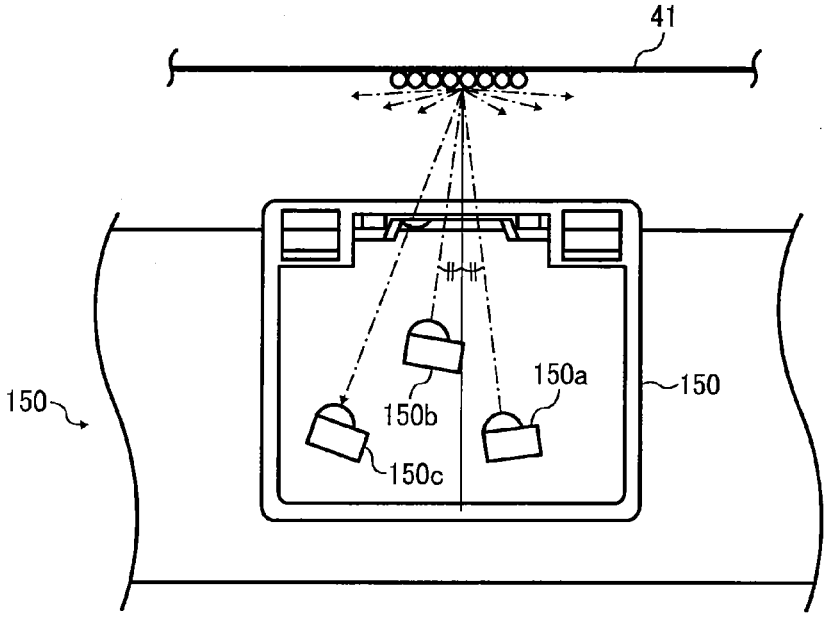
FIG. 12 is an enlarged configuration diagram illustrating an optical sensor with an intermediate transfer belt of the printer.

As illustrated in FIG. 1, an optical sensor 150 faces the front surface of a part of the intermediate transfer belt 41 which is hung on the nip inlet roller 49 among the whole area in the circumferential direction. FIG. 12 is an enlarged configuration diagram illustrating the optical sensor 150 and the intermediate transfer belt 41. The optical sensor 150 configured by a multireflection optical sensor has an light-emitting diode (LED) 150*a* as a light source, a regular reflection photodetector 150*b*, and a diffuse reflection photodetector 150*c*. The optical sensor 150 emits a light beam from the LED 150*a*, then has the light beam regularly reflected from the surface of the intermediate transfer belt 41, and receives the regularly reflected light by the regular reflection photodetector 150*b*, while outputting from the regular reflection photodetector 150*b* a voltage according to a light receiving amount of the regularly reflected light. Also, the optical sensor 150 emits a light beam from the LED 150*a*, then has the light beam diffusely reflected from the surface of the intermediate transfer belt 41, and receives the diffusely reflected light by the diffuse reflection photodetector 150*c*, while outputting from the diffuse reflection photodetector 150*c* a voltage according to a light receiving amount of the diffusely reflected light. When a test toner image formed on the intermediate transfer belt 41 (detailed later) passes the position opposite to the optical sensor 150, the above-described light receiving amounts of the regularly reflected light and the diffusely reflected light show the optical characteristics of the test toner image. When a clear background surface (hereinafter just "surface") of the belt 41 passes the position opposite to the optical sensor 150, the above-described light receiving amounts of the regularly reflected light and the diffusely reflected light show the optical characteristics of the surface of the belt 41.

Figure 13:
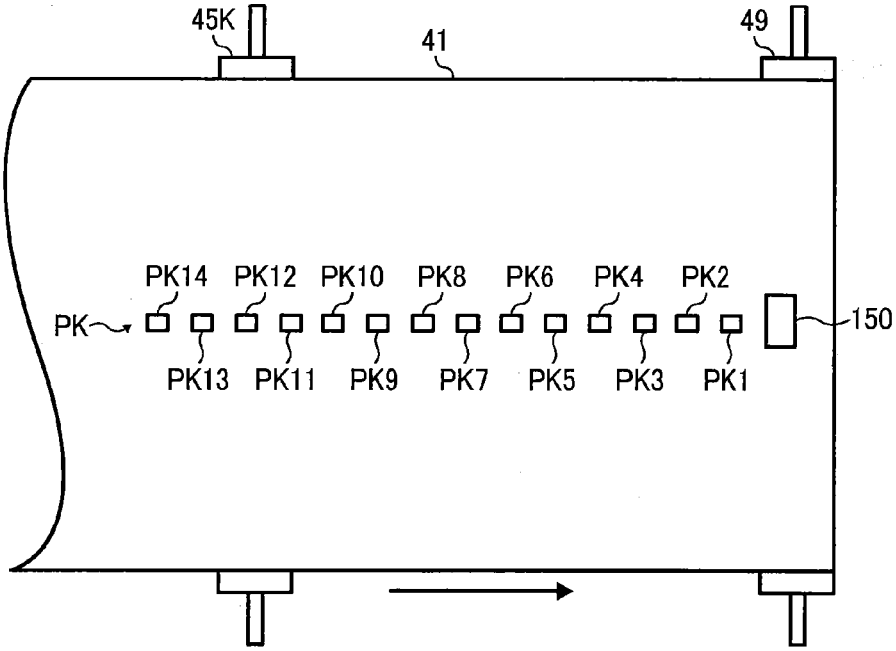
FIG. 13 is a plan view illustrating the intermediate transfer belt of the printer and a K-gradation pattern image formed on the belt.

The control device 100 of the present printer 200 is configured to perform process control processing described below immediately after the power supply is turned on or for each printing of a predetermined number of sheets. In the process control processing, Y-, C-, M-, and K-tone pattern images made of the Y-, C-, M-, and K-toner are formed, respectively. These tone pattern images each includes a plurality of test toner images, and are formed in a central area in the transverse direction of the intermediate transfer belt 41 so that they pass the position opposite to the optical sensor 150. In the case of the K-tone pattern image PK, the pattern image PK includes, as illustrated in FIG. 13, for example, fourteen K-test toner images, i.e., a first K-test toner image PK1, a second K-test toner image PK2, a third K-test toner image PK3, . . . , and a fourteenth K-test toner image PK14 with an amount of adhered toner gradually increasing in this order. The output voltages from the optical sensor 150, at the times when these K-test toner images pass the position opposite to the optical sensor 150, are sent to the control device 100 via an I/O interface and stored in the RAM. Also, the toners of the other colors Y, C, and M, the Y-, C-, and M-tone pattern images PY, PC, and PM each including fourteen Y-, C-, and M-test toner images are formed as in the case of the K-toner. The output voltages from the optical sensor 150 at the times when these fourteen Y-, C-, and M-test toner images pass the position opposite to the optical sensor 150, respectively, are stored in the RAM. FIG. 13 illustrates the intermediate transfer belt 41 viewed upward from the bottom in the vertical direction.

The control device 100 converts the output voltages from the optical sensor 150 stored in the RAM into the adhesion amounts of Y-, C-, M-, and K-toners per unit area for Y, C, M, and K, respectively, based on the output voltages from the optical sensor 150 stored in the RAM and an algorithm previously stored in the ROM, and stores the resultant adhesion amounts per unit area in the RAM.

Figure 14:
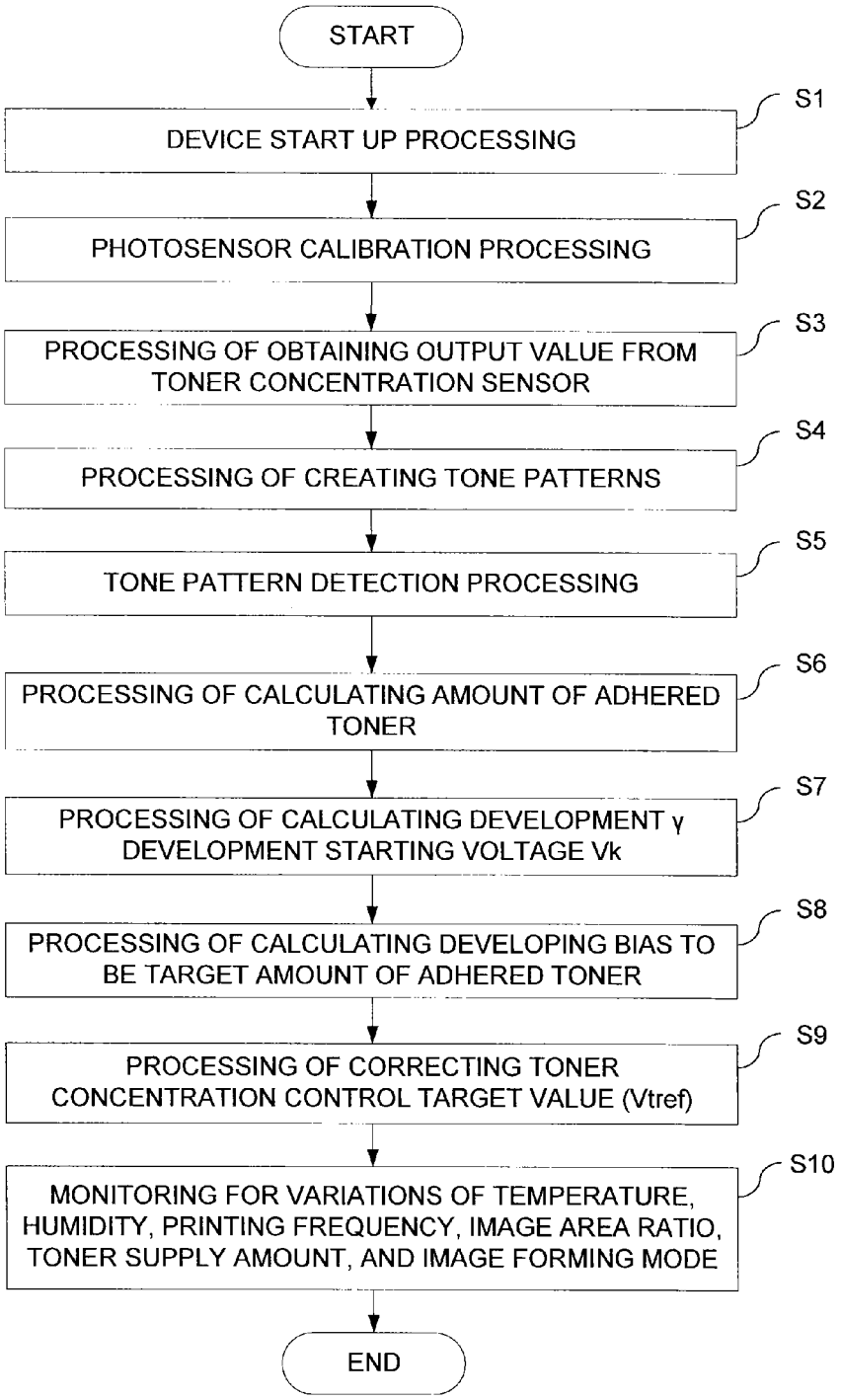
FIG. 14 is a flowchart showing respective processes performed in process control processing.

FIG. 14 is a flowchart showing respective processes performed in process control processing. In the process control processing, device start up processing (step 1: hereinafter, step is abbreviated to S), photosensor (optical sensor 150) calibration processing (S2), processing of obtaining an output value from the toner concentration sensor (S3), processing of creating a tone pattern image (S4), a tone pattern detection process (S5), processing of calculating an amount of adhered toner (S6), processing of calculating a developing bias to be a target adhesion amount (S8), processing of correcting a toner concentration control target value (Vtref) (S9) are performed, and monitoring for variations of temperature, humidity, printing frequency, image area ratio and toner supply amount (S10).

In the device start up processing (S1), drive of the respective motors and the respective devices are started and the process waits until the motors and devices are stably driven. The optical sensor 150 may have the output from the LED 150*a* varied or the sensitivity of the photodetectors 150*b* and 150*c* varied due to temperature change or aging deterioration. Therefore, even though the optical sensor 150 keeps supplying a constant current to the LED 150*a*, the output voltage value from the photodetectors 150*b* and 150*c* of the optical sensor 150 in detecting the surface of the belt 41 may vary over time. The output voltage value from the photodetectors 150*b* and 150*c* may also vary over time due to aging variation of the surface property of the belt 41. For that reason, when performing the process control processing, it is required that the photosensor calibration processing is performed so that the photodetectors 150*b* and 150*c* outputs a constant voltage when detecting the surface of the intermediate transfer belt 41.

In the photosensor calibration processing (S2), the amount of the current supplied to the LED (light emission amount of LED) is adjusted so that the output voltage value from the regular reflection photodetector 150*b* is within a predetermined range in the optical sensor 150. Hereinafter, the output voltage value from the photodetector 150*b* at this time will be referred to as "belt surface output value Vsg". As the amount of the current supplied to the LED 150*a* is increased, the light emission amount of the LED 150*a* increases and the light receiving amount of the regular reflection photodetector 150*b* increases. In contrast, as the amount of the current supplied to the LED 150*a* is decreased, the light emission amount of the LED 150*a* decreases and the light receiving amount of the regular reflection photodetector 150*b* decreases.

Detailed steps in the photosensor calibration processing (S2) will be described below. That is, after the current supply to the LED 150*a* is started for each photosensor 150*b* and 150*c*, the amount of the current supplied to the LED 150*a* is adjusted so that the output voltage value from the regular reflection photodetector 150*b* is 4±0.5 [V]. Hereinafter, the amount of the current supplied to the LED 150*a* will be referred to as "LED current Ifsg".

The control device 100 searches for the LED current Ifsg which can bring the output voltage value from the regular reflection photodetector 150*b* closest to 4.0 [V] by using a binary search technique. As a result of the binary search, when the LED current Ifsg which can limit the output voltage value from the regular reflection photodetector 150*b* to 4±0.5 [V] is not found, a belt surface output value Vsg adjustment error is returned. When the belt surface output value Vsg adjustment error is returned three times in succession, the control device 100 proceeds to processing of abnormal condition occurrence error, in which it shuts down the image forming apparatus 200 in emergency and displays the message to that effect. Note that, in the present printer 200, the upper limit of the LED current Ifsg is set to 30 [mA] for the purpose of preventing the LED 150*a* from being damaged due to overcurrent.

When the control device 100 finds the LED current Ifsg which can limit the output voltage value from the regular reflection photodetector 150*b* to 4±0.5 [V] and also can bring the output voltage value closest to 4.0 [V] by using the binary search technique, it stores the value to the RAM. Thereafter, the control device 100 keeps supplying the LED current Ifsg to the LED 150*a* until it finishes the process control processing.

When the initial value of the LED current Ifsg is set to a considerably low value, it takes a long time to complete the adjustment of the belt surface output value Vsg. Therefore, the control device 100 reads out the value of the LED current Ifsg used the last time in performing the calibration processing from the RAM, and adopts the value as the initial value. Then, under the condition of the initial value, the control device 100 measures the belt surface output value Vsg at predetermined intervals and calculates the average value. When the average value is within 4.0±0.5 [V], the control device 100 adopts the LED current Ifsg as is.

When the control device 100 has completed the calibration processing of the optical sensor 150 in this manner (S2), the control device 100 next performs the process of obtaining an output value from the toner concentration sensor 10 (S3). In the obtaining process, the control device 100 obtains the output voltage values Vt for the above-described Y-, C-, M-, and K-toner concentration sensors (10Y, 10C, 10M, 10K), respectively, and stores the values in the RAM. The control device 100 obtains the output voltage values Vt from the Y-, C-, M-, and K-toner concentration sensors 10 for future use in correcting the control target values of the toner concentrations for Y, C, M, and K, respectively.

Next, the control device 100 performs the processing of creating a tone pattern image (S4) to form the Y-, C-, M-, and K-tone pattern images on the intermediate transfer belt 41. Although only the K-tone pattern image PK is illustrated among the tone pattern images of the respective colors in FIG. 13, in the processing of creating a tone pattern image (S4), the Y-, C-, M-, and K-tone pattern images PY, PC, PM, and PK are formed in line in the direction of travel of the belt 41. Each of the tone pattern images includes fourteen test toner images, and the optical characteristics of the test toner images are detected by the optical sensor 150.

Each of the fourteen test toner images of the tone pattern images of the respective colors has the following sizes. The length of the test toner image in the width direction of the belt 41 is 10 [mm], the length in the direction of travel of the belt 41 is 14.4 [mm], and a gap between the preceding test toner image and the following test toner image is 5.6 [mm]. Although the number of test toner images in the tone pattern image is not limited to fourteen, it is desirable that the test toner images are formed by the number to be contained within the center-to-center distance of the adjacent photoreceptors. On the condition that the length of the tone pattern image in the direction of travel of the belt 41 is longer than the above-described center-to-center distance, forming of the tone pattern images of the respective colors cannot be started at the same time. Therefore, the start time of the image forming needs to be shifted so that the tail end of the preceding tone pattern image is not overlaid on the leading end of the following tone pattern image. This is because the tone pattern image having the length longer than the center-to-center distance of the adjacent photoreceptors (3Y, 3C, 3M, and 3K) causes the process control processing to take a longer time.

In the present printer 200, regardless of the image density (adhesion amount of toner) of the test toner image in forming the tone pattern image, the intensity of the optical writing of a latent image of the test toner image is set to the maximum (the intensity for forming a solid image). Then, the printer 200 changes the developing bias and the charging bias for the respective test toner images to give different image densities to these test toner images.

According to the configuration of detecting the tone pattern images of the respective colors with a single optical sensor 150 as that of the present printer 200, even in the case where the image concentration differs between one end and the other end of the width direction of the belt 41, the image densities of the test toner images can be correctly detected without being affected by the variance of the image densities. In contrast, according to a configuration of shifting the positions of forming the tone patterns of the respective colors in the width direction of the belt 41 and detecting the respective images with dedicated photosensors, the tone pattern images can be formed and detected in shorter time periods than the above case, but detection of the images is affected by the variance of the image densities.

When the control device 100 has formed the tone pattern images of the respective colors, it performs the tone pattern detection processing (S5) for detecting the adhesion amount of toner (image density) per unit area in each of the fourteen test toner images of the Y-, M-, C-, and K-tone pattern images. The control device 100 detects the amount of adhered toner only based on the amount of regularly reflected light from the test toner images of the K-tone pattern image. In contrast, the control device 100 detects the amount of adhered toner based on the amount of regularly reflected light and the amount of diffusely reflected light from the test toner images of the C-, M-, and K-tone pattern images.

As described above, the Y-tone pattern image is formed first of all the tone pattern images of four colors Y, C, M, and K. The time period from when the Y-tone pattern image is started to be formed and until the first test toner image of the Y-tone pattern image enters immediately below the optical sensor 150 (hereinafter, referred to as "detection time lag") is previously decided according to the process linear velocity (the speed of belt 41 or the like) and the distance between the photoreceptors 3Y, 3C, 3M, and 3K and the optical sensor 150 in performing the process control. However, since the intermediate transfer belt 41 does not move exactly at the design speed and since there is a margin of error for the distance between the photoreceptor and the sensor, there is a certain degree of error in the detection time lag. Even though the maximum possible error occurs in the detection time lag, the control device 100 starts obtaining the output voltage value from the optical sensor 150 at the timing at which the leading end of the Y-tone pattern image is reliably detected.

Next, the control device 100 performs the processing of calculating an amount of toner adhered to the belt 41 (S6). In this arithmetic processing, the amount of adhered toner of the K-test toner image of the K-tone pattern image is calculated as below. First, calculations are performed about the belt surface output value Vsg and the toner image output value Vsp from the regular reflection photodetector 150*b* as below.

[Expression 1]

$$\Delta Vsg_reg = Vst_reg - Voffset_reg \quad (1)$$

[Expression 2]

$$\Delta Vsp_reg[n] = Vsp_reg[n] - Voffset_reg \quad (2)$$

In the above equations, "_reg" indicates the output voltage value from the regular reflection photodetector 150*b*. The above equations obtain a difference between the belt surface output value Vsg and the offset voltage Voffset and a difference between the toner image output value Vsp and the offset voltage Voffset. The offset voltage Voffset represents the output voltage value from the photodetector 150*b* at the time when the light emission of the LED 150*a* is turned off. Meanwhile, n in the equation represents the number of the K-test toner image. That is, the above-described differences are calculated for all the fourteen K-test toner images in the tone pattern image. By obtaining the differences between the measured values and the offset voltage Voffset, an increase in the amount of adhered toner of the K-test toner image can be recognized.

Next, the control device 100 obtains a normalized value of the differences by the following equation.

[Expression 3]

$$\text{Normalized value } Rn[n] = \frac{\Delta Vsp_reg[n]}{\Delta Vsg_reg} \quad (3)$$

Then, the control device 100 obtains the adhesion amounts of toner on the respective K-test toner images based on the algorithm (graph, calculation formula, data table, or the like) indicating relationship between the previously stored normalized value Rn and the amount of adhered toner.

Figure 15:
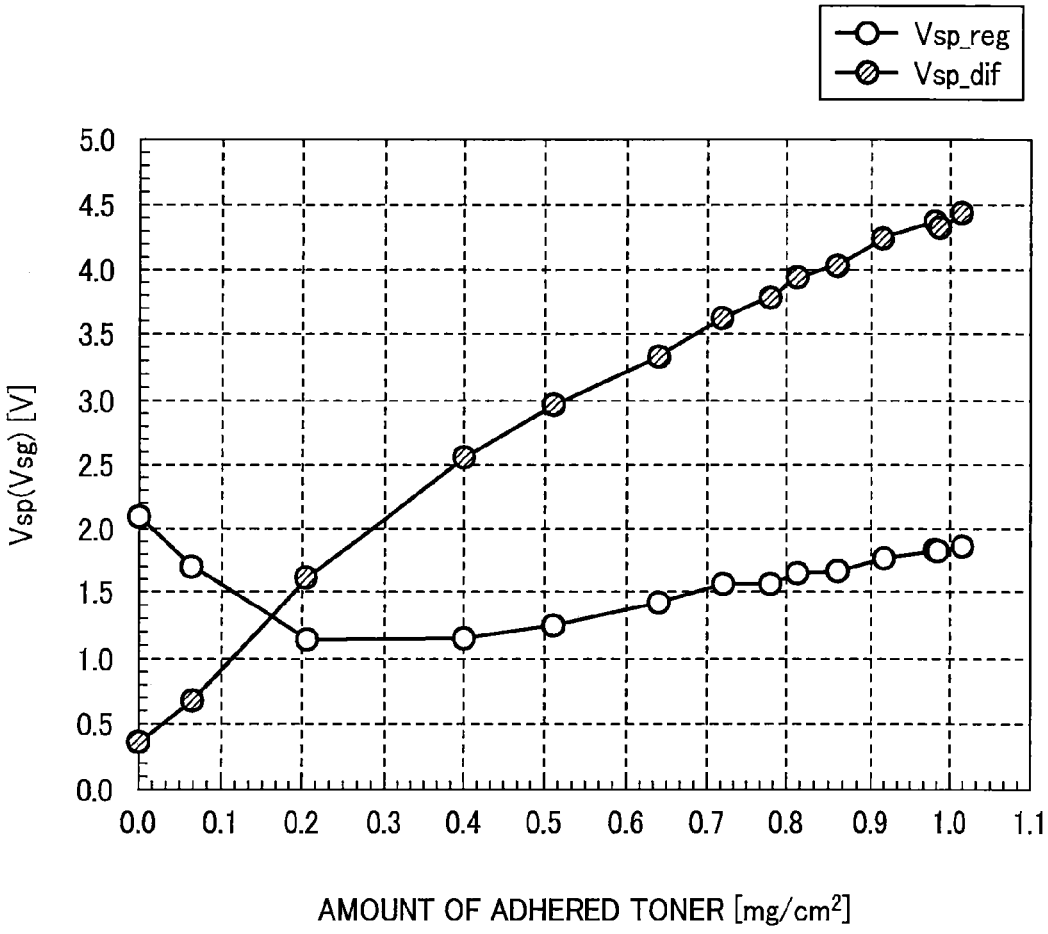
FIG. 15 is a graph showing relationship between an output voltage from a photosensor and an amount of adhered toner on a color test toner image.
Figure 16:
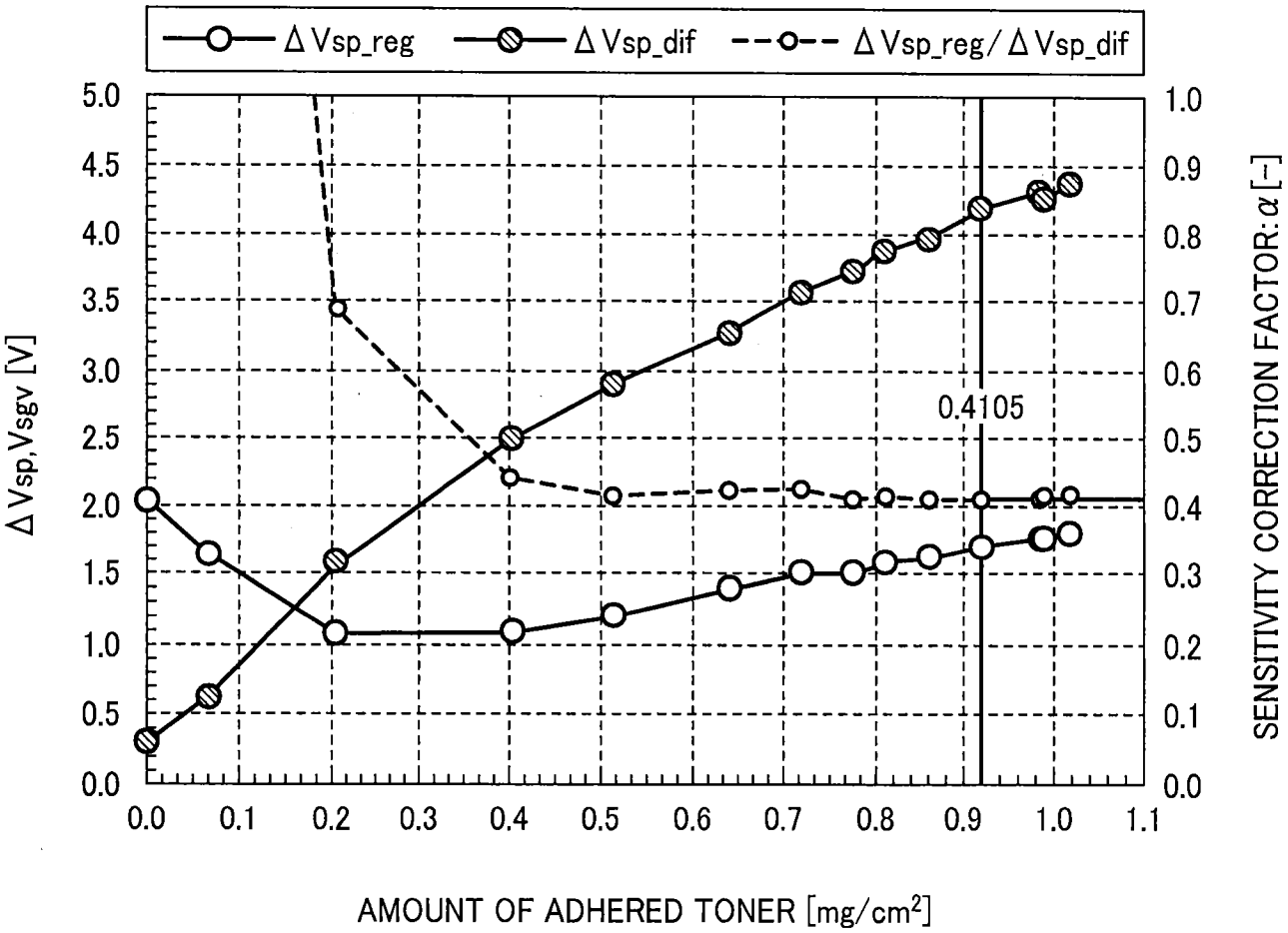
FIG. 16 is a graph showing relationship between difference of toner image output value and the amount of adhered toner.

The amount of adhered toner of each of the test toner images of the Y-tone pattern image, the C-tone pattern image, and M-tone pattern image is obtained as below. FIG. 15 is a graph showing relationship between a sensor output value and the amount of adhered toner of a color test toner image. First, the control device 100 obtains a difference between the toner image output value Vsp and the offset voltage Voffset of each of the fourteen test toner images for each color of Y, C, and M as the following equation. In the following equation, "_dif" indicates the output voltage value from the diffusely reflected light photodetector 150*c*.

[Expression 4]

$$\Delta Vsp_reg.[n] = Vsp_reg.[n] - Voffset_reg \quad (4)$$

[Expression 5]

$$\Delta Vsp_dif.[n] = Vsp_dif.[n] - Voffset_dif \quad (5)$$

Next, the control device 100 obtains a sensitivity correction factor α for performing correction on the toner image output value Vsp_dif from the diffusely reflected light photodetector 150*c* according to the sensitivity of the diffusely reflected light photodetector 150*c* as below.

[Expression 6]

$$\alpha = \min\left(\frac{\Delta Vsp_reg[n]}{\Delta Vsp_dif.[n]}\right) \quad (6)$$

Here, the ratio of the sensitivity correction factor α is obtained as the minimum value because it is known that the minimum value of the regular reflection component of the toner image output value Vsp_reg from the regular reflection photodetector 150*b* is almost zero and is a positive value. As a result of multiplying the toner image output value Vsp_dif [n] from the diffusely reflected light photodetector 150*c* by the sensitivity correction factor α obtained in the above-described manner, a graph showing relationship between the difference in toner image output value Vsp_dif and the amount of adhered toner is corrected as the graph shown in FIG. 16, for example.

Next, the control device 100 factors the diffusely reflected light component and the regularly reflected light component with respect to the difference in toner image output value Vsp_reg from the regular reflection photodetector 150*b*, respectively, by using the following equation. In Expression 7, ΔVsp_reg_dif[n] represents the diffusely reflected light component of the difference. In Expression 8, ΔVsp_reg_reg [n] represents the regularly reflected light component of the difference.

[Expression 7]

$$\Delta Vsp_reg._dif.[n] = \Delta Vsp_dif.[n] \times \alpha \quad (7)$$

[Expression 8]

$$\Delta Vsp_reg._reg.[n] = \Delta Vsp_reg.[n] - \Delta Vsp_reg._dif.[n] \quad (8)$$

Figure 17:
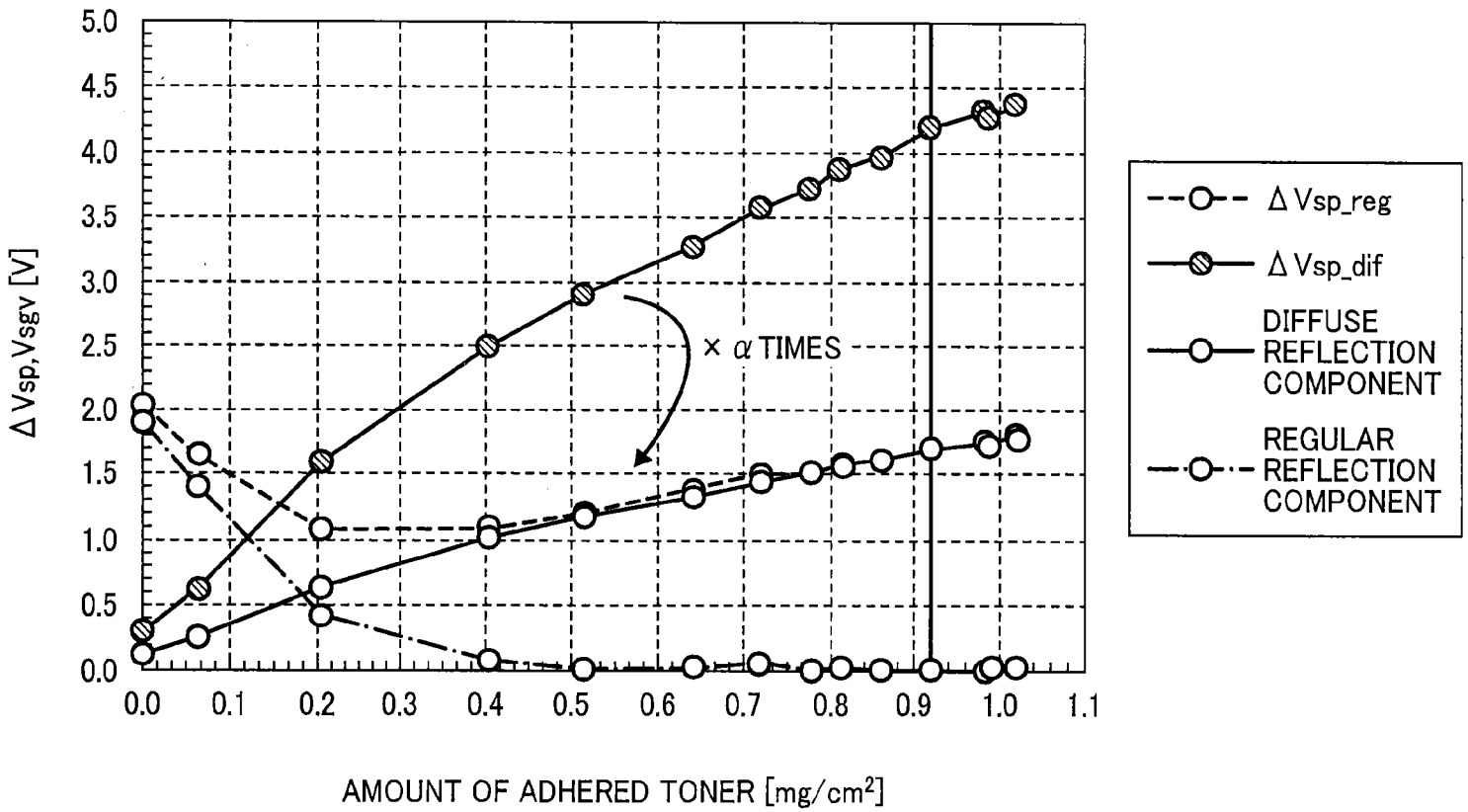
FIG. 17 is a graph showing relationship between difference of toner image output value from a regularly reflected light photodetector of the photosensor and the amount of adhered toner.

In the above-described manner, the control device 100 extracts only a pure regularly reflected light component by separating the diffusely reflected light component from the difference in the toner image output value Vsp_reg from the regular reflection photodetector 150*b*. As a result, as shown in FIG. 17, for example, a graph showing relationship between the difference in the toner image output value Vsp_reg from the regular reflection photodetector 150*b* and the amount of adhered toner is corrected to the graph reflecting only the pure regular reflection component.

Next, the control device 100 normalizes the fourteen regular reflection components respectively corresponding to the fourteen test toner images for the regular reflection photodetector 150*b* by using the following equation.

[Expression 9]

$$\text{Normalized value: } \beta[n] = \frac{\Delta Vsp_reg._reg}{\Delta Vsg_reg._reg} \quad (9)$$

( = the exposure ratio of the surface of the transfer belt)

Further, the control device 100 removes the diffused light output component of the belt surface output value Vsp=dif from the toner image output value Vsp_dif for the diffusely reflected light photodetector 150*c* by using the following equation.

[Expression 10]

$$\Delta Vsp_dif' = [\text{diffused light output voltage}] - [\text{belt surface output}] \times [\text{normalized value of the regular reflection component}] = \Delta Vsp_dif(n) - \Delta Vsg_dif \times \beta(n) \quad (10)$$

As described above, in an area of low amount of adhered toner which is sensitive to the regularly reflected light, the control device 100 extracts only the regularly reflected light component which can uniquely represent relationship with the amount of adhered toner from the regularly reflected light, and removes [the diffusely reflected light component which is directly reflected from the surface of the belt 41] from the diffusely reflected light. Then, the control device 100 performs sensitivity correction on the diffusely reflected light output based on these results. The sensitivity correction is performed for performing the following corrections. That is, the correction about an individual difference in sensitivity of the LED 150*a* and the photodetectors 150*b* and 150*c*, and the correction about the temperature characteristics and the aging deterioration characteristics of the LED 150*a* and the photodetectors 150*b* and 150*c*.

Figure 18:
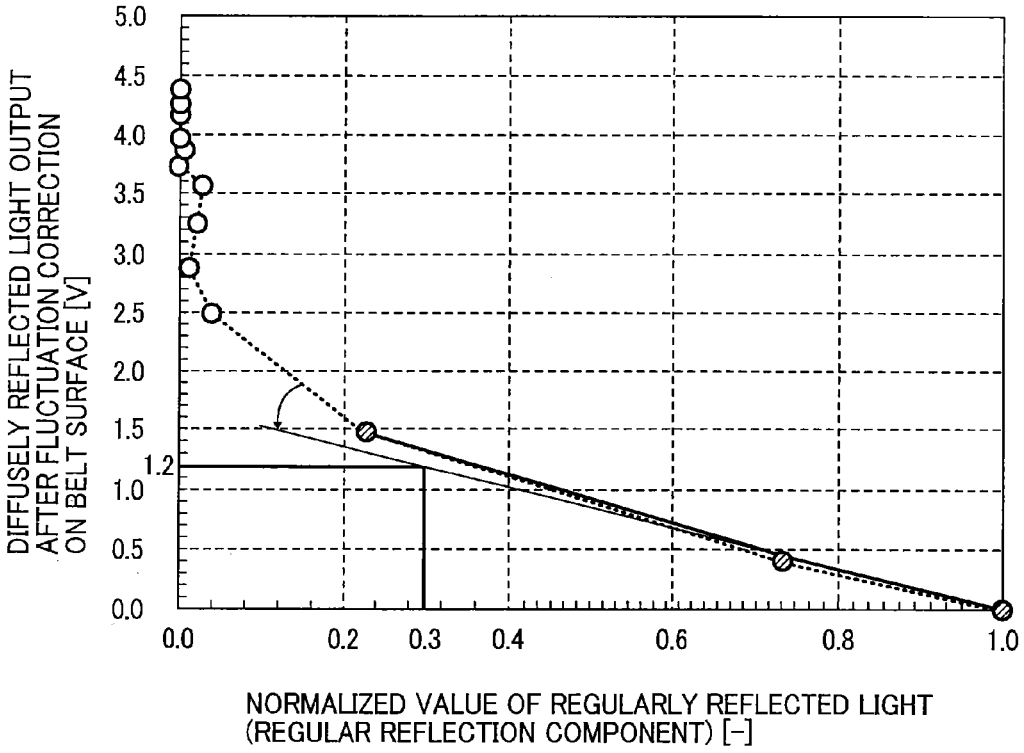
FIG. 18 is a graph showing relationship between a normalized value of a regular reflection component of a regularly reflected light in the photosensor and a diffusely reflected light output which has been subjected to fluctuation correction on a surface of the belt.

The corrections are performed as below. As illustrated in FIG. 18, the control device 100 plots the diffusely reflected light outputs, which have been subjected to fluctuation correction on the surface of the belt 41, on the "normalized value of the regular reflection component of the regularly reflected light area". Then, based on the linear relationship in the area of low amount of adhered toner, the control device 100 obtains the sensitivity of the diffusely reflected light outputs, and performs correction to bring the sensitivity to the previously determined target sensitivity. The sensitivity of the diffusely reflected light outputs is the slope of the straight line shown in the graph of FIG. 18, and the control device 100 corrects the sensitivity of the diffusely reflected light outputs by calculating a correction factor to be multiplied by the current slope so that a diffusely reflected light output, which has been subjected to fluctuation correction on the surface of the belt 41 of a certain normalized value, becomes a certain value. The slope of the straight line is obtained by the least square method.

A method of approximating the points plotted on the graph is shown below. That is, polynomial approximation (linear approximation) is performed on a plot line that is made by the diffused light outputs, which have been subjected to fluctuation correction on the surface of the belt 41, plotted on the "normalized value of the regular reflection component of the regularly reflected light", and the sensitivity correction factor η is calculated. More specifically, first, the plot line is approximated by using a linear approximation formula (y=ξ1x2+ξ2x+ξ3), and factors ξ1, ξ2, and ξ3 are calculated by using the least square method as the following equation. Note that, m in the following equation represents the number of data, x[i] represents a normalized value of the regular reflection component of the regularly reflected light, and y[i] represents the diffused light output that has been subjected to fluctuation correction on the surface of the belt 41. Here, x used in the calculation ranges is, for example, 0.1≤x≤1.00.

[Expression 11]

$$\xi_1 \sum_{i=1}^{m} x[i]^2 + \xi_2 \sum_{i=1}^{m} x[i]^1 + \xi_3 \sum_{i=1}^{m} x[i]^0 = \sum_{i=0}^{m} y[i]x[i]^0 \quad (11)$$

[Expression 12]

$$\xi_1 \sum_{i=1}^{m} x[i]^3 + \xi_2 \sum_{i=1}^{m} x[i]^2 + \xi_3 \sum_{i=1}^{m} x[i]^1 = \sum_{i=0}^{m} y[i]x[i]^1 \quad (12)$$

[Expression 13]

$$\xi_1 \sum_{i=1}^{m} x[i]^4 + \xi_2 \sum_{i=1}^{m} x[i]^3 + \xi_3 \sum_{i=1}^{m} x[i]^2 = \sum_{i=0}^{m} y[i]x[i]^2 \quad (13)$$

Next, a sensitivity correction factor η for determining a normalized value "a" that is calculated by the plot line approximated in the above-described manner to be a certain value "b" is obtained by the following equation.

[Expression 14]

$$\eta = \frac{b}{\xi_1 a^2 + \xi_2 a + \xi_3} \quad (14)$$

Then, as in the following equation, the control device 100 corrects the relationship between the amount of adhered toner and the diffused output to be the previously determined relationship by multiplying the diffused light output, which has been subjected to fluctuation correction on the surface of the belt 41, obtained in the expression 10, by the sensitivity correction factor η. Note that ΔVsp_dif' in the following equation represents the diffused light output obtained in the expression 10.

[Expression 15]

$$\Delta Vsp_dif'' = [\text{diffused light output subjected to fluctuation correction on the belt surface}] \times [\text{sensitivity correction factor: } \eta] = \Delta Vsp_dif[n]' \times \eta \quad (15)$$

The control device 100 performs the above-described correction to suppress the power variation of the LED 150*a* and the photodetectors 150*c* caused by the temperature change or aging deterioration, so that the relationship between the output voltage value from the photodetectors 150*b* and 150*c* and the amount of adhered toner is corrected to a unique relationship.

Next, the control device 100 converts ΔVsp_dif" into the amount of adhered toner by using an adhesion amount conversion table. The control device 100 can convert the output voltage value into the amount of adhered toner by referencing the adhesion amount conversion table based on the corrected output voltage value.

Figure 19:
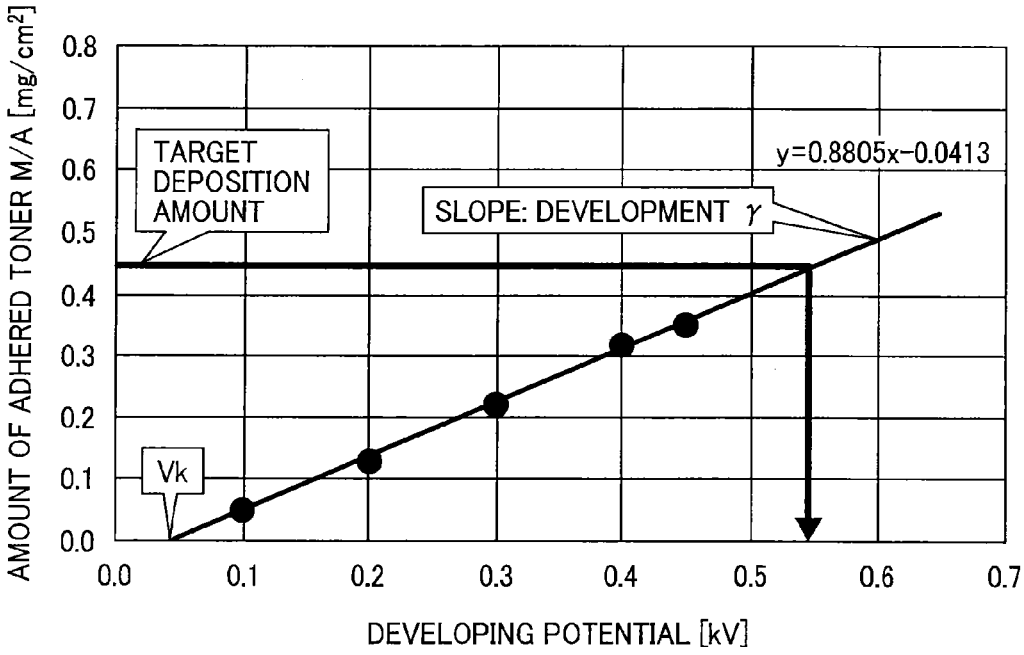
FIG. 19 is a graph showing relationship between the amount of adhered toner and developing potential.

As described above, when the amount of adhered toner on each of the fourteen test toner images for the tone pattern images of the respective colors is obtained, the control device 100 then performs the processing of calculating the developing bias to be a target adhesion amount (S8). Specifically, first, as illustrated in FIG. 19, the control device 100 obtains the approximate straight line which indicates relationship between the developing potential at the time when the test toner image is developed (the potential difference between the electrostatic latent image and the developing sleeve) and the amount of adhered toner (target deposition amount) on the test toner image by using the least square method. Then, the slope of the approximate straight line is obtained as the development γ. Also, the x-intercept of the approximate straight line is obtained as a development starting voltage Vk.

Next, based on the approximate straight line, the control device 100 obtains the developing potential which can provide the target amount of adhered toner (in the illustrated example, 4.5 mg/cm$^2$), and from the result, the control device 100 calculates the developing bias which can provide the target amount of adhered toner (developing bias Vb [−V]=(developing potential−|latent image potential|)×(−1)). Note that, the charging bias Vc for imaging is previously determined to bring the value of the electric potential of a clear background surface (hereinafter just "surface") of the photoreceptor 3 to a level not to cause the magnetic carrier of the developer to adhere to the photoreceptor.

When the control device 100 obtained the developing bias Vb, it then performs the processing of correcting a toner concentration control target value (Vtref) (S9). In the correction processing, the control device 100 obtains Δγ by subtracting a predetermined target development γ from the development γ obtained in S8. The target development γ is a previously determined numerical value and, for example, a value to be adopted as the target development γ may be the value which can provide the amount of adhered toner of 1.0 [mg/cm$^2$] on the condition that the developing potential=1000 [−V]. In this case, since the development starting voltage Vk is assumed to be 0 [−V], if the target amount of adhered toner is 0.5 [mg/cm$^2$], the developing potential is required to be 500 [−V]. Here, the developing potential [−V] =developing bias Vb—the latent image potential, therefore, on the condition that the latent image potential is 50 [−V], the developing bias Vb=550 [−V]. In the event that Δγ exceeds the predetermined value, Vb may exceed the settable range or an abnormal image may be formed. Therefore, the toner concentration control target value (Vtref) is corrected to bring Δγ within the target range. However, if Vt at this time greatly differs from Vtref, the correction is not performed.

For example, it is assumed that Δγ≥0.30 [mg/cm$^2$/−kV] (high) and Vt−Vtref≥−0.2 [V] (example 1). In this case, Vtref=Vt−0.2 [V]. That is, the toner concentration control target value Vtref is set to decrease the current toner concentration. On the other hand, it is assumed that Δγ≤0.30 [mg/cm$^2$/−kV] (low) and Vt−Vtref≤0.2 [V] (example 2). In this case, Vtref=Vt+0.2 [V]. That is, the toner control target value is set to increase the current toner concentration. In the cases other than the examples 1 and 2, the previous toner concentration control target value Vtref is left as is without being corrected.

The control device 100 is configured to periodically perform the above-described process control processing.

Figure 20:
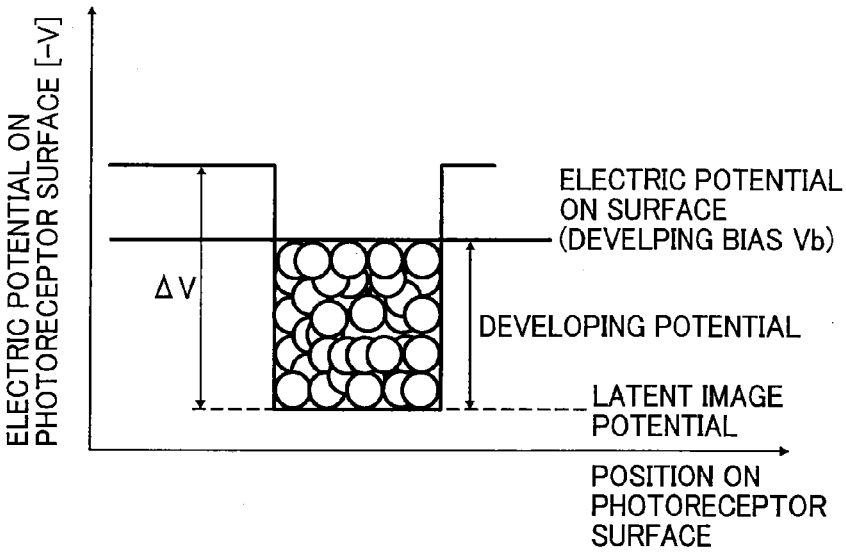
FIG. 20 is a graph showing relationship between electric potential on a photoreceptor surface and a position on the photoreceptor surface.

FIG. 20 is a graph showing relationship between electric potential on a photoreceptor surface and a position on the photoreceptor surface. The printer 200 is configured to support a so-called reversal development. The present printer uses a negatively charged toner and uniformly charges the surface of the photoreceptor with a negative polarity by using a charging device. In the graph of FIG. 20, the electric potential on the photoreceptor surface on the axis of ordinates is expressed by the unit [−V]. Therefore, as the value becomes farther from the origin on the axis of ordinates, the value becomes larger in the negative direction. The electric potential on the surface of the photoreceptor 3 is the electric potential of an area in which uniformly charged state by the charging device is remained, in the whole area of the photoreceptor 3. The electric potential of the latent image that has been written as a result of exposure of the surface of the photoreceptor 3 has a negative polarity similarly to the electric potential of the surface of the photoreceptor 3, but the absolute value of the latent image is smaller than that of the surface of the photoreceptor 3. This is because the electric potential with negative polarity on surface of the photoreceptor 3 has been attenuated by exposure.

The developing bias Vb to be applied to the developing roller 12 of the developing unit 7 has the value of negative polarity similarly to the electric potential of surface of the photoreceptor 3 and the electric potential of the latent image, and has the absolute value between that of the electric potential of the surface of the photoreceptor 3 and that of the electric potential of the latent image. The developing potential that is the potential difference between the developing bias Vb and the electric potential of the latent image has an effect of attracting the toner on the developing roll toward the electrostatic latent image. Therefore, as the developing potential increases, the amount of adhered toner of the electrostatic latent image (development density) per unit area increases.

The magnitude of the developing potential depends on such factors as the magnitude of the charging bias with respect to the charging roller 6 of the charging device 5 which influences the electric potential of the surface of the photoreceptor 3, the laser intensity of the laser optical system 20 which influences the decay rate of the electric potential of the surface of the photoreceptor 3 in exposure, and the developing bias Vb. Since the toner adheres to the latent image by the amount to compensate most of the developing potential with the amount of charge of the aggregation of toner, the amount of adhered toner is not only dependent on the developing potential but also on the toner charge amount (Q/M). Therefore, the developing ability of the imaging unit is greatly influenced by the toner charge amount. Since the toner charge amount is influenced by such factors as the temperature and humidity and printing frequency, the developing ability is also influenced by the temperature and humidity and the printing frequency (frequency of performing image forming operation).

Figure 21:
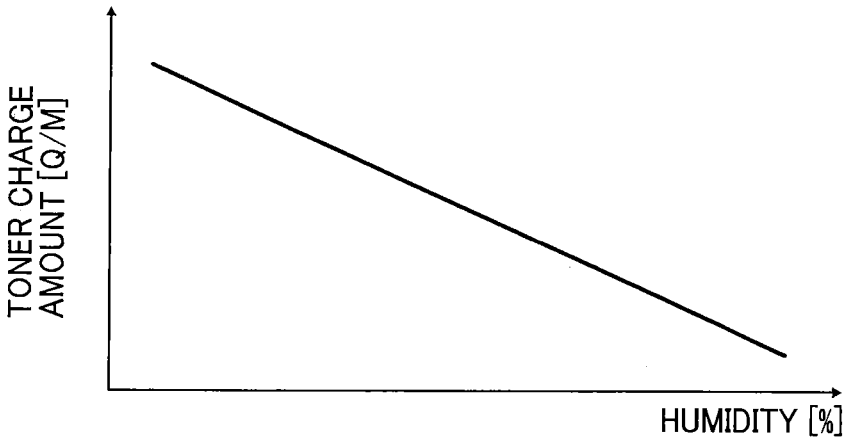
FIG. 21 is a graph showing relationship between the toner charge amount (Q/M) in developer and humidity.

Specifically, as illustrated in FIG. 21, when the humidity is relatively high, the toner charge amount (Q/M) in the two-component developer is lower than that in the case of a medium humidity. The relationship between the temperature and the toner charge amount is the same as the relationship between the humidity and the toner charge amount. As a result, when the humidity and the temperature are relatively high, the toner charge amount (Q/M) decreases and, accordingly, the developing ability increases so as to easily make the development density excessively dense. In contrast, when the temperature and humidity are relatively low, the toner charge amount (Q/M) in the two-component developer becomes higher than in the case where the temperature and humidity are at medium level, and accordingly, the developing ability decreases so as to easily cause the poor development density. When the printing frequency is relatively high, the frequency of the toner particles being rubbed against each other while being stirred in the developing unit increases, and therefore, the toner charge amount (Q/M) increases. As a result, the developing ability decreases so as to easily cause poor development density. In contrast, when the printing frequency is relatively low, the frequency of the toner particles being rubbed against each other while being stirred in the developing unit decreases, and therefore, the toner charge amount (Q/M) decreases. As a result, the developing ability increases so as to easily increase the development density excessively high.

Then, the control device 100 is configured to monitor the variation of temperature or the variation of humidity and the variation of the printing frequency for an event to change the developing ability, and when the variations exceed predetermined threshold values, the control device 100 perform the target value correction processing to correct the control target value of the toner concentration (S10), as illustrated in FIG. 14. Although the control target value of the toner concentration is also corrected in the above-described process control processing, the target value correction processing is performed completely separately from the process control processing.

The first purpose of performing the process control processing is to compensate the change in the developing potential caused by degradation of the parts of the imaging unit with a change of conditions such as the bias. Specifically, when the photoreceptor deteriorates through repeated use, the photoreceptor becomes hard to be charged. Therefore, in the case where the charging bias is kept constant regardless of the deterioration, the electric potential of the surface of the photoreceptor 3 decreases over time so that a desired developing potential is not obtained. Not only the deterioration of the photoreceptor but also the deterioration of various devices such as the laser optical system and the developing roll may cause aged deterioration of the developing potential. Then, the control device 100 periodically performs the process control to correct the charging bias, the developing bias, the laser intensity and the like so that a desired developing potential is obtained regardless of deterioration of devices.

In contrast, the purpose of performing the target value correction processing for correcting the control target value of the toner concentration is not to stabilize the developing potential but to stabilize the toner charge amount (Q/M).

The control device 100 periodically monitors the detected result from an ambient detector 120 (see FIG. 10) constituted by a temperature sensor or a humidity sensor. When the variation of temperature or the variation of humidity after the preceding target value correction processing exceeds a threshold value, the control device 100 performs the target value correction processing. The control device 100 also monitors the printing frequency (proportion of print job performance time period per hour) for every minute. When the variation of the printing frequency after the preceding target value correction processing exceeds a predetermined threshold value, the control device 100 also performs the target value correction processing. Specifically, the control device 100 stores in the ROM an algorithm indicating relationship between a combination of the temperature or the humidity and the printing frequency and the optimal control target value of the toner concentration for the combination. In the target value correction processing, the control device 100 identifies the above-described combination based on the detected result of the temperature or humidity and the calculated result of the printing frequency. Then, the control device 100 identifies the optimal control target value of the toner concentration corresponding to the combination by the above-described algorithm, and corrects the set value of the control target value to be the same as that of the identified result.

It is possible to stabilize the developing ability to some extent to obtain a constant development density by performing the above-described target value correction processing separately for Y, C, M and K. However, it is difficult to promptly respond to rapid changes in the temperature, the humidity, and the printing frequency. Specifically, when the temperature or humidity rapidly changes in response to a user's action of switching on the air conditioner, or the like, it is necessary to greatly correct the control target value of the toner concentration by performing the target value correction processing. However, at the time of greatly correcting the control target value of the toner concentration, the toner concentration of the two-component developer in the developing device is greatly apart from the corrected control target value. Thereafter, it takes certain time to have the toner concentration of the two-component developer greatly changed to the corrected control target value. Since the toner concentration of the two-component developer deviates from the appropriate value during that period of time, an excessive development density or a poor development density may occur in that period.

Next, a characteristic configuration of the printer 200 will be described.

The toner concentration of the two-component developer is the control parameter that influences the developing ability of the latent image, but many other control parameters that influence the developing ability are set to the imaging unit 1. For example, since the developing bias Vb determines the developing potential, it is the control parameter (second control parameter) which influences the developing ability. Upon correcting the control target value of the developing bias Vb, the developing bias Vb in the development area changes to the corrected value. Therefore, the developing bias Vb is the control parameter having a quite fast response speed when the developing ability is changed by correction. In contrast, as described above, the toner concentration is the control parameter (first control parameter) having a quite slow response speed when the developing ability is changed by correction.

In the target value correction processing, the control device 100 is configured to perform at least substitution correction processing, normal correction processing, and substitution value return correction processing. Specifically, the normal correction processing is for correcting the control target value of the toner concentration, and only the normal correction processing is performed in the conventional target value correction processing.

On the other hand, the substitution correction processing is for correcting the control target value of the developing bias Vb having a response speed faster than the toner concentration as a first control parameter, with a correction amount corresponding to the correction amount of the control target value of the toner concentration in the normal correction processing. Specifically, the control device 100 stores in the ROM a data table indicating correspondence between the correction amount of the control target value of the toner concentration and the correction amount of the control target value of the developing bias Vb. The data table is constructed according to a preliminary experiment and associates the variation (correction amount) of the developing bias that causes a change in the development density equal to the case where the toner concentration is changed with the correction amount of the control target value of the toner concentration. Based on the data table, the control device 100 identifies the correction amount of the control target value of the developing bias Vb corresponding to the correction amount of the control target value of the toner concentration, and corrects the control target value of the developing bias Vb to the same value as that of the identified result. As a result, the printer 200 can instantly obtain the same effect as that in the case where the toner concentration is changed to the corrected control target value. That is, the printer can instantly restore the developing ability to a desired level by correcting the control target value of the developing bias Vb through the substitution correction processing.

After starting the target value correction processing, the control device 100 first identifies the corrected value (hereinafter, referred to as "correction value") of the control target value of the toner concentration based on the detected result of the temperature or humidity detected by the ambient detector 120, the calculated result of the printing frequency, and the above-described algorithm. Then, the control device 100 calculates the difference between the correction value and the current set value of the control target value as the correction amount. Next, the control device 100 identifies the correction amount of the control target value of the developing bias Vb corresponding to the obtained correction amount based on the above-described data table.

After having identified the correction amount of the control target value of the developing bias Vb in this manner, the control device 100 performs the substitution correction processing to correct the control target value of the developing bias Vb based on the correction amount. Concurrently with the substitution correction processing, the control device 100 performs the normal correction processing. In this normal correction processing, the control device 100 corrects the control target value of the toner concentration to the same value as the above correction value.

After a while the control device 100 started the normal correction processing, the toner supply or print job has proceeded, so that the toner concentration of the two-component developer changes to almost the same value as the corrected control target value. At this time or a little earlier than this time, the control device 100 performs the substitution value return processing. In the substitution value return processing, the control device 100 returns the control target value of the developing bias Vb that has been corrected by the substitution correction processing to the original value.

The present printer 200 having the above configuration performs the target value correction processing in the case where the variation of humidity or the variation of temperature exceeds a threshold value or where the variation of the printing frequency exceeds a threshold value as an event to change the developing ability of the latent image. Then, in the substitution correction processing in the target value correction processing, the printer 200 corrects the control target value of the developing bias Vb as the second control parameter having a response speed faster than the toner concentration as the first control parameter. As a result, the printer 200 promptly returns the developing ability that has changed by such a factor as the temperature change to the original developing ability. Further, through the normal correction processing, the printer 200 corrects the control target value of the toner concentration having a response speed slower than the developing bias Vb. Then, at the time when the correction of the control target value of the toner concentration has been reflected on the developing ability, i.e., when the actual toner concentration has changed close to the corrected control target value, the printer 200 keeps the target developing ability as is by returning the control target value of the developing bias Vb to the original value by performing the substitution value return processing. Through such series of processing, the printer 200 can suppress occurrence of a poor development density from when the control target values of the control parameters are corrected and until the correction is reflected on the developing ability.

The correction of the control target value of the developing bias Vb is only a temporary measure and cannot completely substitute the correction of the control target value of the toner concentration. The reason for this is as follows. When the control target value of the developing bias Vb is corrected, not only the developing potential but also the potential difference between the developing bias Vb and the electric potential of the surface of the photoreceptor 3 are changed in association with the change in the developing bias Vb. For example, in the graph shown in FIG. 20, if the value of the developing bias Vb is increased and, accordingly, the developing potential is increased, the potential difference between the developing bias Vb and the electric potential of the surface of the photoreceptor 3 is correspondingly decreased. When the potential difference becomes too small, the edge portion of the image becomes blurred. In the substitution correction processing, priority is given to the stabilization of the development density over the occurrence of the blur of the edge portion for the temporary correction of the control target value of the developing bias Vb. When only the control target value of the developing bias Vb is corrected and the control target value of the toner concentration is not corrected, the edge portion is still blurred as before. Then, the printer 200 can correct the control target value of the toner concentration as in the conventional manner, and when the correction is reflected on the developing ability, the control target value of the developing bias Vb is returned to the original value to eliminate the blur of the edge portion.

Next, there will be described printers 200 of respective examples in which the printer 200 according to the embodiment is added with more typical features. The printers of the respective examples have the same configuration as that of the present embodiment, unless otherwise stated.

First Embodiment

In a printer according to the first embodiment, in the normal correction processing of the target value correction processing, the control device 100 stepwise increases the control target value of the toner concentration to gradually increase the correction amount of the control target value of the toner concentration as the first control parameter. More specifically, when the correction amount of the control target value of the toner concentration is relatively large, correcting the control target value with whole of that correction amount causes a large amount of toner to be supplied in a short time. As a result, the actual toner concentration may overshoot the target value. Particularly, in the configuration of deciding the toner supply amount by the PI control as in the present printer, the toner concentration tends to overshoot as described above.

Therefore, in the normal correction processing, the control device 100 stepwise corrects the control target value of the toner concentration. Specifically, in the present printer, in the case where the control target value of the toner concentration is corrected to the high concentration side, it takes approximately one minute for the actual toner concentration to increase to the corrected control target value. Once the control device 100 has obtained the correction amount of the control target value of the toner concentration, it divides the correction amount by six to obtain the divided correction amount. In the normal correction processing, first, the control device 100 corrects the current control target value of the toner concentration to the sum of the current control target value and the divided correction amount. Ten seconds later, the control device 100 corrects the control target value to the sum of the control target value and the divided correction amount. Thereafter, the control device 100 repeats the same correction every ten seconds, so that the control target value is corrected to the sum of the original control target value and the correction amount in one minute.

With the above configuration, the printer prevents overshoot of the toner concentration by gradually supplying the toner so as to gradually bring the toner concentration close to the corrected control target value. As a result, compared with the case where the printer corrects the control target value of the toner concentration at a time by the normal correction processing, the printer can suppress variation of the development density by stabilizing the developing ability.

Second Embodiment

The printer according to the second embodiment has the same configuration as that of the printer according to the first embodiment except for the points described below. That is, in the substitution value return processing of the target value correction processing, the control device 100 gradually returns the control target value of the developing bias Vb as the second control parameter to the original value by stepwise correcting the control target value of the developing bias Vb. More specifically, the control device 100 divides the correction amount of the control target value of the developing bias Vb in the substitution correction processing by six to obtain the divided correction amount. In the substitution value return processing, first, the control device 100 corrects the current control target value of the developing bias Vb to the remainder of subtracting the divided correction amount from the current control target value. Ten seconds later, the control device 100 corrects the control target value to the remainder of subtracting the divided correction amount from the control target value. Thereafter, the control device 100 repeats the same correction every ten seconds so that the control target value of the developing bias Vb is returned to the initial control target value.

With the above-described configuration, in a process of gradually reflecting the correction of the control target value of the toner concentration as the first control parameter on the developing ability, the printer makes the developing ability more stable in accordance with the process by gradually returning the developing bias Vb as the second control parameter to the original value. As a result, unlike the case where the printer returns the developing bias Vb at a time by the substitution value return processing, the printer can suppress variation of the development density by stabilizing the developing ability.

Third Embodiment

In a continuous image forming operation for continuously forming images on a plurality of recording sheets, the toner charge amount (Q/M) of the two-component developer in the developing unit changes in a short time according to an average output image area ratio or an average toner supply amount. The reason for this is as follows. That is, during the continuous image forming operation, the two-component developer in the developing unit is continuously stirred. Although the toner particles would be subjected to excessive triboelectric charging in this state, some of the toner particles in the two-component developer are consumed in the development and the consumed particles are compensated with new toner particles. Most of the supplied toner particles are not charged. When the average output image area ratio during the continuous image forming operation is relatively high, more toner is consumed and supplied compared to the case of the medium average output image area ratio. Therefore, a ratio of the toner particles of relatively low charge amount increases as soon as the toner is supplied. As a result, the toner charge amount (Q/M) of the two-component developer relatively decreases and, accordingly, the developing ability relatively increases. That is, when the average output image area ratio during the continuous image forming operation is relatively high, the average toner supply amount becomes relatively large, and accordingly, the developing ability becomes relatively high.

In contrast, when the average output image area ratio during the continuous image forming operation is relatively low, less toner is consumed and less toner is supplied compared to the case of the medium average output image area ratio. Therefore, a ratio of the toner particles of relatively high charge amount as a result of repetitive friction increases. Accordingly, the toner charge amount (Q/M) of the two-component developer relatively increases, and the developing ability relatively decreases. That is, when the average output image area ratio during the continuous image forming operation is relatively low, the average toner supply amount becomes relatively small, and accordingly, the developing ability becomes relatively low.

Figure 23:
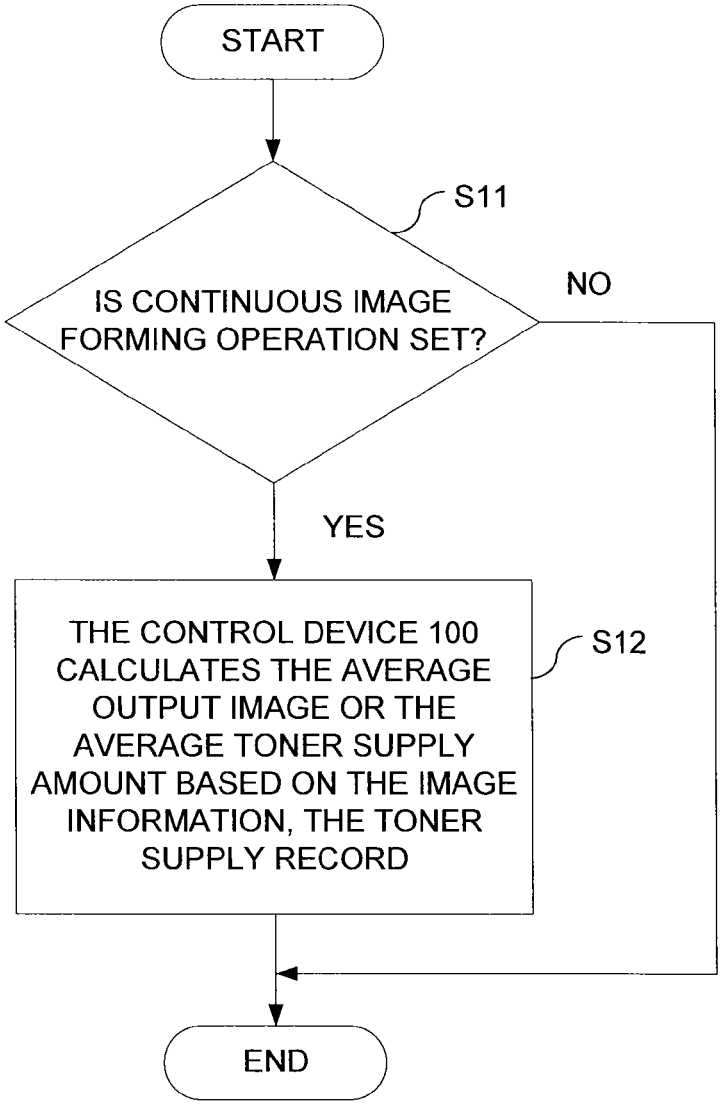
FIG. 23 is a flowchart showing respective processes performed during a continuous image forming operation.

For that purpose, the control device 100 stores in the ROM a standard value of the average output image area ratio and the average toner supply amount during the continuous image forming operation. Then, during the continuous image forming operation (S11), the control device 100 calculates the average output image or the average toner supply amount based on the image information, the toner supply records, or the like (S12), as illustrated in FIG. 23. The average output image area may be exemplified by the value of the image area per recording sheet averaged for a plurality of recording sheets. The average toner supply amount may be exemplified by the value of the toner supply amount per print averaged for a plurality of prints.

During the continuous image forming operation, when a difference between the average output image area or the average toner supply amount and the standard value becomes a threshold value or more, the target value correction processing is performed. Then, according to the difference, the correction amount of the control target value of the toner concentration as the first control parameter and the correction amount of the developing bias Vb as the second control parameter are determined, respectively. Then, based on these correction amounts, the normal correction processing and the substitution correction processing are performed. With this configuration, during the continuous image forming operation, the development can be performed with a stabilized developing ability even in the case of a sudden change in the average output image area ratio or the average toner supply amount.

Fourth Embodiment

A change in the process linear velocity is considered as an event which influences the toner charge amount. The process linear velocity is the surface velocity of the photoreceptor or the like during the image forming operation. The faster the process linear velocity is, the shorter the image forming time becomes. In the present printer, compared with the case where cardboard is used as the recording sheet, the larger amount of heat is taken by the recording sheet during the fixing process, and therefore, there is a risk of a fixing failure.

Then, in the case where cardboard is used as the recording sheet, the user sets the slow print mode for printing. The slow print mode is a mode of using a process linear velocity slower than that of the normal print mode. When the process linear velocity is slow, the amount of heat taken by the cardboard per unit time during the fixing process is equal to that taken by standard paper in the normal print mode, and therefore, occurrence of a fixing failure can be suppressed.

With the present printer, when the user gives higher priority to the printing speed than the image quality, the high-speed print mode may be set for printing. The high-speed print mode is a mode of using a process linear velocity faster than that of the normal print mode. The faster the process linear velocity is, the shorter the image forming time becomes.

When the process linear velocity changes, the developing ability during the current step also changes according to the change of the process linear velocity. For example, in the normal print mode, it is assumed that the developing potential is set to the value for adhering 100 toner particles to a solid latent image of a predetermined area. When the mode is set to the high-speed print mode, a time available for the toner particles to move from the developing roll to the electrostatic latent image in the development area becomes shorter, and therefore, only 90 toner particles, for example, are adhered to the solid latent image under the same condition of the developing potential. As a result, the development density decreases. When the mode is set to the slow print mode, a time available for the toner particles to move from the developing roll to the electrostatic latent image in the development area becomes longer, and therefore, 110 toner particles, for example, are adhered to the solid latent image under the same condition of the developing potential. As a result, the development density increases.

Figure 24:
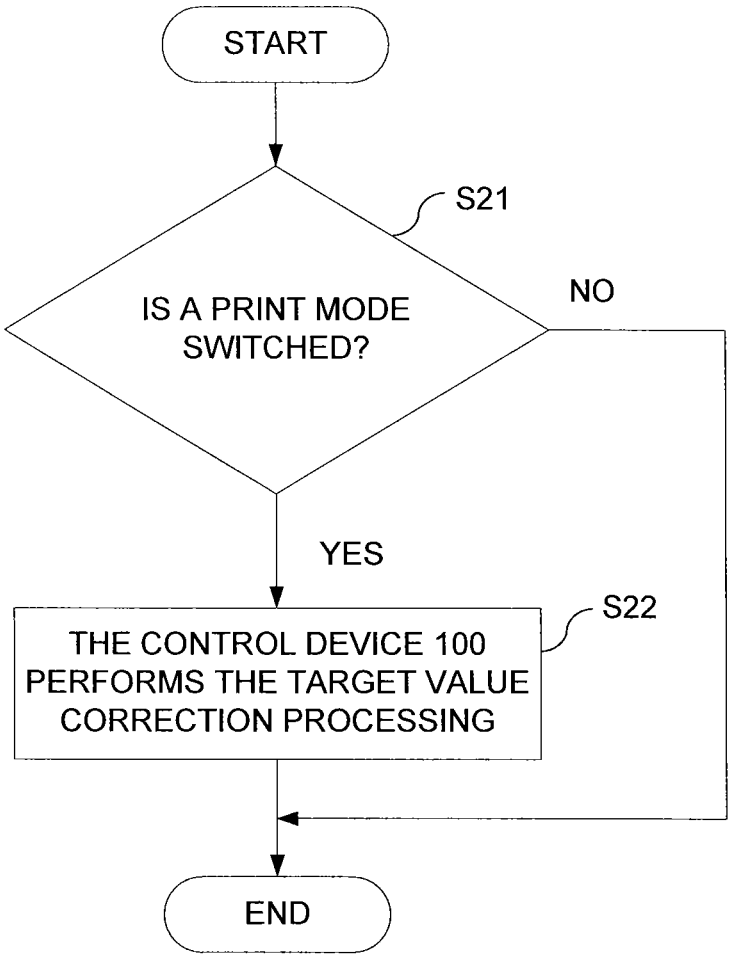
FIG. 24 is a flowchart showing respective processes performed when a print mode is switched.

Therefore, when the normal print mode (normal image forming mode) is switched (S21) to the high-speed print mode (high-speed image forming mode) or the slow print mode (slow image forming mode), the control device 100 performs the target value correction processing (S22), as illustrated in FIG. 24. Then, according to the switched mode, the correction amount of the control target value of the toner concentration and the correction amount of the control target value of the developing bias Vb are determined, respectively. More specifically, in the high-speed print mode, the correction amount of the control target value of the toner concentration and the correction amount of the control target value of the developing bias Vb are determined, respectively, to further improve the developing ability than that of the normal print mode. Conversely, in the slow print mode, the correction amount of the control target value of the toner concentration and the correction amount of the control target value of the developing bias Vb are determined, respectively, to further decrease the developing ability than that of the normal print mode. With this configuration, the development can be performed with a stabilized developing ability even when the print mode changes.

Fifth Embodiment

Figure 22:
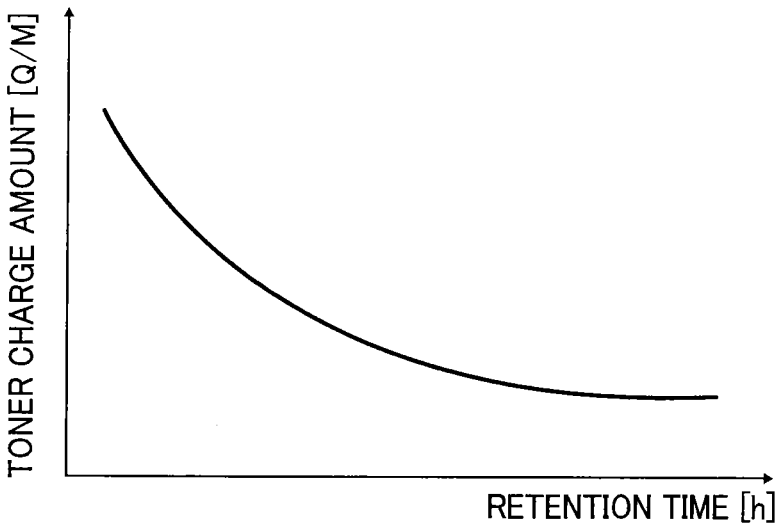
FIG. 22 is a graph showing relationship between the toner charge amount (Q/M) in the developer and retention time.

A change in the retention time is considered as an event which influences the toner charge amount. The retention time is a time period during which the image forming operation is continuously stopped. While the image forming operation stops, the stirring operation of the two-component developer also stops, and therefore, as the retention time becomes longer, the charge amount of the toner in the developing unit gradually decreases as shown in FIG. 22. In the case where a print job is started when the retention time is extended to some extent, the printer tends to have an excessive development density since the toner charge amount is significantly low, that is, the developing ability is significantly high.

After long-term suspension of operations such as the year-end and New Year holidays or summer holidays, the retention time of the printer in company office becomes so long that the toner charge amount becomes significantly low. The retention time can be addressed by previously measuring a change in the toner charge amount for each retention time and preparing a correction table based on the measurements.

When the print job is started in the case where the retention time becomes a threshold value or more, the control device 100 performs the target value correction processing. Then, in the target value correction processing, the correction amount of the control target value of the toner concentration and the correction amount of the control target value of the developing bias Vb are determined, respectively, according to the length of the retention time. With this configuration, the printer can perform the development with a stabilized development density by stabilizing the developing ability at the time when the continuous stopping state is changed to the print job regardless of the length of the retention time.

After the control device 100 has returned the control target value of the developing bias Vb to the original value in the substitution value return processing, it performs the target value correction processing again when the printing frequency increases to some extent as in the printer according to the embodiment. Then, the control device 100 returns the control target value of the toner concentration which has been corrected in the preceding target value correction processing to the original value by correcting the control target value according to an increase of the toner charge amount after that. With this configuration, the printer can prevent the development density from decreasing over time in the case where the continuous stopping state is changed to the print job and then the control target value of the toner concentration is brought to a constant value regardless of increase of the printing frequency.

Although there has been described an example in which the control target value of the toner concentration as the first control parameter is corrected and the control target value of the developing bias Vb as the second control parameter is corrected, the first control parameter is not limited to the toner concentration. Further, the second control parameter is not limited to the developing bias Vb. For example, in the case where the control device 100 corrects the control target value of the laser intensity as the first control parameter with the normal correction processing for some reason, the control device 100 may correct the control target value of the developing bias as the second control parameter having a response speed faster than the laser intensity with the substitution correction processing. Further, in the case where the control device 100 corrects the control target value of the charging bias as the first control parameter with the normal correction processing, it may correct the laser intensity as the second control parameter having a response speed faster than the charging bias with the substitution correction processing.

The printers have been described above just as examples, and the present invention has an effect specific to each of the aspects below.

[Aspect A]

An aspect A is an image forming apparatus 200 including: an imaging device (for example, imaging units 1Y, 1C, 1M, and 1K) and a controller (for example, a control device 100). Each of the imaging devices 1Y, 1C, 1M and 1K includes a latent image carrier (for example, photoreceptors 3Y, 3C, 3M, and 3K) to carry a latent image on a surface thereof; a latent image writing device (for example, an optical writing unit 20) to write the latent image on the surface of the latent image carrier; and a developing device (for example, developing units 7Y, 7C, 7M, and 7K) to develop the latent image on the surface of the latent image carrier with toner. The controller 100, when control target value of control parameters that influence a developing ability of the imaging unit becomes inappropriate, performs target value correction processing of correcting the control target value to bring the control target value close to an appropriate value for stabilizing a development density of the imaging unit 1. In the target value correction processing, the controller 100 corrects a control target value of a second control parameter having a response speed, obtained when the developing ability is changed by the correction, faster than a first control parameter, corrects the control target value of the first control parameter, and then turns the control target value of the second control parameter back to the original value.

[Aspect B]

In an aspect B of the image forming apparatus 200, in addition to the aspect A, the imaging unit 1 further includes a charging device (for example, a charging unit 5Y) to uniformly charge the surface of the latent image carrier (for example, 3Y). The latent image writing unit 20 writes a static latent image on the uniformly-charged surface of the latent image carrier 3Y. The developing device (for example, 7Y), having a developer carrier (for example, a developing roll 12Y) develops the static latent image with developer containing the toner and carrier carried on a surface of the developer carrier 12Y. In the target value correction processing, the controller 100 corrects the target value of the first control parameter indicating a parameter (toner concentration of the developer) that influences a toner charge amount (Q/M) of the developer in the developing device 7Y, and corrects the control target value of the second control parameter indicating a parameter (developing bias Vb) that influences a developing potential that is a difference between an electric potential of the static latent image on the latent image carrier 3Y and an electric potential of the developer carrier 12Y. With this configuration, as described above, the aspect B can promptly restore the developing ability by correcting the control target value of the second control parameter (developing bias Vb) that influences the developing potential compared to the case where it corrects only the control target value of the first control parameter (toner concentration of the developer) which influences the toner charge amount (Q/M).

[Aspect C]

In an aspect C of the image forming apparatus 200, in addition to the aspect B, in the target value correction processing, the controller 200 performs processing of stepwise increasing a correction amount of the control target value of the first control parameter (toner concentration of the developer) whose response speed is slower than that of the second control parameter (developing bias Vb). With this configuration, as described above, compared with the case where the printer corrects the first control parameter at a time, the aspect C can suppress variation of the development density by stabilizing the developing ability.

[Aspect D]

In an aspect D of the image forming apparatus 200, in addition to the aspect B or C, in the target value correction processing, the controller 200 performs processing of correcting the control target value of the second control parameter (developing bias Vb) whose response speed is faster than that of the first control parameter (toner concentration of the developer), and then stepwise correcting the control target value of the second control parameter (developing bias Vb) to gradually return to the original value. With this configuration, as described above, compared with the case where the printer corrects the second control parameter at a time, the aspect D can suppress variation of the development density by stabilizing the developing ability.

[Aspect E]

In an aspect E of the image forming apparatus 200, in addition to t any of the aspects B to D, when a fluctuation in frequency of performing an image forming operation in each unit time increases to a threshold value or more as the phenomenon of becoming inappropriate of the control target values of the control parameters, the controller 100 performs processing of determining a correction amount of the control target value of the first control parameter (toner concentration of the developer), and a correction amount of the control target value of the second control parameter (developing bias Vb), respectively, depending on the frequency of performing the image forming operation. With this configuration, as described above, the aspect E can perform the development with a stabilized development density by stabilizing the developing ability regardless of the fluctuation in the frequency of performing an image forming operation.

[Aspect F]

In an aspect F of the image forming apparatus 200, in addition to any of the aspects B to D, the image forming apparatus 200 further includes an ambient detector 120 to detect an ambient temperature or an ambient humidity. When a fluctuation in temperature or humidity increases to a threshold value or more as the phenomenon of becoming inappropriate of the control target values of the control parameters, the controller 100 performs processing of determining a correction amount of the control target value of the first control parameter (toner concentration of the developer), and a correction amount of the control target value of the second control parameter (developing bias Vb), respectively, depending on a detected result of temperature or humidity by the ambient detector 120. With this configuration, as described above, the aspect F can perform the development with a stabilized development density by stabilizing the developing ability regardless of the fluctuation in temperature or humidity.

[Aspect G]

In an aspect G of the image forming apparatus 200, in addition to any of the aspects B to D, the imaging unit 1 outputs an image on a sheet, and new toner is supplied to the developing device 7Y when the toner in the developer is consumed in development. When a difference between an average output image area ratio in a continuous image forming operation and a output-image standard value or between an average toner supply amount of the developing device in the continuous image forming operation and a toner-supply standard value becomes a threshold value or more as the phenomenon of becoming inappropriate of the control target values of the control parameters, the controller 100 performs processing of determining a correction amount of the control target value of the first control parameter (toner concentration of the developer), and a correction amount of the control target value of the second control parameter (developing bias Vb), respectively, in the continuous image forming operation depending on the difference. With this configuration, as described above, the aspect G can perform the development with a stabilized development density by stabilizing the developing ability during the continuous image forming operation regardless of a sudden change in the average output image area ratio or the average toner supply amount.

[Aspect H]

In an aspect H of the image forming apparatus 200, in addition to any of the aspects B to D, when a normal image forming mode in which an image forming speed is normal speed has changed to a fast image forming mode in which the image forming speed is faster than the normal speed or a slow image forming mode in which the image forming speed is slower than the normal speed as the phenomenon of becoming inappropriate of the control target values of the control parameters, the controller 100 performs processing of determining a correction amount of the control target value of the first control parameter (toner concentration of the developer), and a correction amount of the control target value of the second control parameter (developing bias Vb), respectively, in the fast image forming mode or the slow image forming mode, depending on the image forming speed. With this configuration, as described above, the aspect H can perform the development with a stabilized development density by stabilizing the developing ability regardless of the change in the image forming mode.

[Aspect I]

In an aspect I of the image forming apparatus 200, in addition to any of the aspects B to D, when a continuous stopping period of an image forming operation has elapsed equal to or more than a threshold value as the phenomenon of becoming inappropriate of the control target values of the control parameters, the controller 100 performs processing of determining a correction amount of the control target value of the first control parameter (toner concentration of the developer), and a correction amount of the control target value of the second control parameter (developing bias Vb), respectively, respectively, depending on the continuous stopping period immediately before a start of the image forming operation. With this configuration, as described above, the aspect I can perform the development with a stabilized development density by stabilizing the developing ability at the time when the continuous stopping state is changed to the image forming operation regardless of the length of the continuous stopping time.

[Aspect J]

In an aspect J of the image forming apparatus 200, in addition to the aspects I in the target value correction processing, the controller 100 performs processing of returning the control target value of the second control parameter (developing bias Vb) to the original value, and then returning the control target value of the first control parameter (toner concentration of the developer) to the original value depending on a state of increasing the frequency of performing the image forming operation in each unit time. With this configuration, as described above, the aspect J can prevent the development density from decreasing over time in the case where the continuous stopping state is changed to the image forming operation and then the first control parameter is brought to a constant value regardless of increase of the printing frequency.

In the present invention, when the developing ability of the imaging device is stabilized by the correction of the control target value of the first control parameter, not only the control target value of the first control parameter but also the control target value of the second control parameter having a response speed faster than the first control parameter is corrected. As a result, the present invention promptly changes the developing ability of the imaging device to the appropriate value. Then, the present invention keeps the target developing ability as is by returning the control target value of the second control parameter to the original value when the correction of the control target value of the first control parameter is actually reflected on the developing ability of the imaging device. With the series of processing, the present invention can suppress occurrence of a poor development density from when the control target value of the control parameter is corrected and until the correction is reflected on the developing ability.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an imaging unit including:

a latent image carrier to carry a latent image on a surface thereof;

a latent image writing device to write the latent image on the surface of the latent image carrier; and a developing device to develop the latent image on the surface of the latent image carrier with toner; and a controller, when control target values of control parameters that influence a developing ability of the imaging unit becomes inappropriate, performs target value correction processing of correcting the control target values to bring the control target values close to appropriate values for stabilizing a development density of the imaging unit, wherein, in the target value correction processing, the controller corrects a second control target value of a second control parameter having a response speed, obtained when the developing ability is changed by the correction, faster than a response speed of a first control parameter, corrects a first control target value of the first control parameter, and then turns the second control target value of the second control parameter back to an original value of the second control parameter after correcting the first control target value of the first control parameter, and wherein in the target value correction processing, the controller performs processing of returning the second control target value of the second control parameter to the original value of the second control parameter after correcting the first control target value of the first control parameter, and then returning the first control target value of the first control parameter to an original value of the first control parameter before target value correction processing, depending on a state of increasing the frequency of performing the image forming operation in each unit time.

2. The image forming apparatus according to claim 1, wherein the imaging unit further comprises a charging device to uniformly charge the surface of the latent image carrier, wherein the latent image writing device writes a static latent image on the uniformly-charged surface of the latent image carrier, and the developing device, having a developer carrier, develops the static latent image with developer containing the toner and carrier carried on a surface of the developer carrier, and wherein, in the target value correction processing, the controller corrects the target value of the first control parameter indicating a parameter that influences a toner charge amount of the developer in the developing device, and corrects the second control target value of the second control parameter indicating a parameter that influences a developing potential that is a difference between an electric potential of the static latent image on the latent image carrier and an electric potential of the developer carrier.

3. The image forming apparatus according to claim 2, wherein in the target value correction processing, the controller performs processing of stepwise increasing a correction amount of the first control target value of the first control parameter whose response speed is slower than that of the second control parameter.

4. The image forming apparatus according to claim 2, wherein in the target value correction processing, the controller performs processing of correcting the second control target value of the second control parameter whose response speed is faster than that of the first control parameter, and then stepwise correcting the second control target value of the second control parameter to gradually return to the original value of the second control parameter after correcting the first control target value of the first control parameter.

5. The image forming apparatus according to claim 2, wherein, when a fluctuation in frequency of performing an image forming operation in each unit time increases to at least a threshold value, the controller performs processing of determining a correction amount of the first control target value of the first control parameter and a correction amount of the second control target value of the second control parameter, respectively, depending on the frequency of performing the image forming operation.

6. The image forming apparatus according to claim 2, further comprising an ambient detector to detect an ambient temperature or an ambient humidity, wherein, when a fluctuation in temperature or humidity increases to at least a threshold value, the controller performs processing of determining a correction amount of the first control target value of the first control parameter and a correction amount of the second control target value of the second control parameter, respectively, depending on a detected result of temperature or humidity by the ambient detector.

7. The image forming apparatus according to claim 2, wherein the imaging unit outputs an image on a sheet, and new toner is supplied to the developing device when the toner in the developer is consumed in development, and wherein, when a difference between an average output image area ratio in a continuous image forming operation and an output-image standard value or between an average toner supply amount of the developing device in the continuous image forming operation and a toner-supply standard value becomes at least a threshold value, the controller performs processing of determining a correction amount of the first control target value of the first control parameter and a correction amount of the second control target value of the second control parameter, respectively, in the continuous image forming operation depending on the difference.

8. The image forming apparatus according to claim 2, wherein, when a normal image forming mode in which an image forming speed is normal speed has changed to a fast image forming mode in which the image forming speed is faster than the normal speed or a slow image forming mode in which the image forming speed is slower than the normal speed, the controller performs processing of determining a correction amount of the first control target value of the first control parameter and a correction amount of the second control target value of the second control parameter, respectively, in the fast image forming mode or the slow image forming mode, depending on the image forming speed.

9. The image forming apparatus according to claim 2, wherein, when a continuous stopping period of an image forming operation has elapsed equal to or more than a threshold value, the controller performs processing of determining a correction amount of the first control target value of the first control parameter and a correction amount of the second control target value of the second control parameter, respectively, depending on the continuous stopping period immediately before a start of the image forming operation.

* * * * *